US011039723B2

(12) United States Patent
Pruiett

(10) Patent No.: US 11,039,723 B2
(45) Date of Patent: Jun. 22, 2021

(54) SURFACE CLEANING APPARATUS

(71) Applicant: BISSELL Inc., Grand Rapids, MI (US)

(72) Inventor: Jason W. Pruiett, Grand Rapids, MI (US)

(73) Assignee: BISSELL Inc., Grand Rapids, MI (US)

( * ) Notice: Subject to any disclaimer, the term of this patent is extended or adjusted under 35 U.S.C. 154(b) by 0 days.

(21) Appl. No.: 17/083,419

(22) Filed: Oct. 29, 2020

(65) Prior Publication Data

US 2021/0038041 A1 Feb. 11, 2021

Related U.S. Application Data

(60) Provisional application No. 62/931,244, filed on Nov. 6, 2019.

(51) Int. Cl.
*A47L 9/28* (2006.01)
*A47L 9/19* (2006.01)

(52) U.S. Cl.
CPC ..... *A47L 9/2826* (2013.01); *A47L 9/19* (2013.01); *A47L 9/281* (2013.01); *A47L 9/2894* (2013.01)

(58) Field of Classification Search
CPC ..... A47L 9/2826; A47L 9/19; A47L 9/281; A47L 9/2894
See application file for complete search history.

(56) References Cited

U.S. PATENT DOCUMENTS 5,323,483 A * 6/1994 Baeg ..... G01F 1/74 388/811
5,608,944 A * 3/1997 Gordon ..... A47L 9/281 15/319
5,815,884 A * 10/1998 Imamura ..... A47L 9/19 15/339
6,131,237 A * 10/2000 Kasper ..... A47L 5/225 15/320
6,446,302 B1 * 9/2002 Kasper ..... A47L 11/30 15/319
6,637,546 B1 * 10/2003 Wang ..... A47L 9/2805 181/264
6,864,985 B1 * 3/2005 Tanzer ..... G01N 21/51 356/337
7,228,589 B2 6/2007 Miner et al.
7,269,877 B2 9/2007 Tondra et al.
(Continued)

FOREIGN PATENT DOCUMENTS

CN 11134573 5/2020
CN 111134572 5/2020
(Continued)

*Primary Examiner* — Marc Carlson
(74) *Attorney, Agent, or Firm* — Warner Norcross + Judd LLP

(57) ABSTRACT

A surface cleaning apparatus includes a controller coupled to a sensor or a set of sensors that collects and transmits data to a remote computing device. The surface cleaning apparatus can use wireless or networking technology with a protocol for wireless communication with the remote computing device. The remote computing device is configured to identify an event at the surface cleaning apparatus and/or a change in the cycle of operation of the surface cleaning apparatus based on the transmitted data. Sensor data can be transmitted from the remote computing device to a different surface cleaning apparatus.

20 Claims, 21 Drawing Sheets

(56) References Cited

U.S. PATENT DOCUMENTS

| | | | | |
|---|---|---|---|---|
| 7,320,149 | B1 * | 1/2008 | Huffman | A47L 11/24 15/319 |
| 8,719,998 | B1 * | 5/2014 | Huffman | A47L 11/34 15/319 |
| 9,474,424 | B2 * | 10/2016 | Moyher, Jr. | A47L 7/0042 |
| 9,737,187 | B2 * | 8/2017 | Bantum | A47L 11/34 |
| 10,092,155 | B2 | 10/2018 | Xia et al. | |
| 2012/0152280 | A1 | 6/2012 | Bosses et al. | |
| 2015/0191927 | A1 * | 7/2015 | Tavor | E04H 4/1654 15/1.7 |
| 2016/0256026 | A1 * | 9/2016 | Kuperus | G01N 15/0826 |
| 2017/0049288 | A1 * | 2/2017 | Knutson | A47L 11/4088 |
| 2018/0070787 | A1 * | 3/2018 | Gordon | G05D 1/02 |
| 2018/0078106 | A1 * | 3/2018 | Scholten | A47L 9/1683 |
| 2018/0110388 | A1 * | 4/2018 | Xia | A46B 13/001 |
| 2018/0116476 | A1 * | 5/2018 | Bloemendaal | A47L 11/4044 |
| 2018/0136042 | A1 | 5/2018 | Goldring et al. | |
| 2018/0221920 | A1 * | 8/2018 | Piwonka-Corle | B08B 3/08 |
| 2018/0344114 | A1 * | 12/2018 | Scholten | A47L 9/2894 |
| 2020/0345190 | A1 * | 11/2020 | Buehler | A47L 9/2884 |

FOREIGN PATENT DOCUMENTS

| | | | | |
|---|---|---|---|---|
| WO | 2020082066 | | 4/2020 | |
| WO | WO-2020082066 | A1 * | 4/2020 | A47L 11/40 |

* cited by examiner

SURFACE CLEANING APPARATUS

CROSS-REFERENCE TO RELATED APPLICATION(S)

The present application claims the benefit of U.S. Provisional Patent Application No. 62/931,244, filed Nov. 6, 2019, which is incorporated herein by reference in its entirety.

BACKGROUND

Surface cleaning apparatuses are adapted for cleaning various surfaces, such as tile, hardwood, carpet, and upholstery. Often, a suction nozzle adjacent the surface to be cleaned is in fluid communication with a source of suction to draw debris from the surface to be cleaned and collect debris within a tank or other collection space. An agitator can be provided for agitating the surface. Some cleaners comprise a fluid delivery system that delivers cleaning fluid to a surface to be cleaned and a fluid recovery system that extracts spent cleaning fluid and debris (which may include dirt, dust, stains, soil, hair, and other debris) from the surface.

Surface cleaning apparatuses can include microprocessor-based control systems for controlling components or features such as a suction motor, an agitator motor, a bag full indicator, robotic locomotion and autonomous navigation. In some instances, the microprocessors are permanently pre-programmed at the factory with instructions for controlling the features. In other instances, the microprocessors are connected to a remote network and reconfigurable to enable the factory-installed programming to be updated if required.

U.S. Pat. No. 6,637,546 discloses a carpet cleaning machine provided with a microprocessor that controls various components. The microprocessor is software controlled and can provide sequential operating instructions to the operator, enforce start-up and shut down sequences, store an electronic record of operating parameters for future use, provide auto- and remote diagnostics, and provide remote control. The software is updated via a modem.

U.S. Pat. No. 7,269,877 discloses a floor care appliance provided with a microprocessor-based control arrangement having a communications port for connection to a computer. Once connected to a computer, software updates for the microprocessor can be downloaded, or diagnostic information stored in the microprocessor's memory can be uploaded for diagnostic purposes. The communication port can be connected to a local computer for possible further connection to a remote computer over a network.

Consumers still want to know more information about their cleaning devices and want more control of its operation; there remains a need for an improved surface cleaning apparatus that can send and receive data.

BRIEF SUMMARY

According to one aspect of the invention, a connected surface cleaning apparatus is provided. In one aspect of the present disclosure, the surface cleaning apparatus includes a controller coupled to a set of sensors that collects and transmits data to a remote computing device. The surface cleaning apparatus uses wireless or networking technology with a protocol for wireless communication. In one implementation, the surface cleaning apparatus can be Wi-Fi connected with a cloud-connected processor.

According to one aspect of the invention, a surface cleaning device includes a base adapted for contacting a surface of a surrounding environment to be cleaned, at least one electrically-powered suction device, a plurality of sensors configured to generate data during a cycle of operation of the surface cleaning device, a controller configured to collect the data provided by the plurality of sensors, and a connectivity component configured to transmit the data to a remote computing device, or multiple remote computing devices. The remote computing device can be configured to identify an event at the surface cleaning apparatus or a change in the cycle of operation of the surface cleaning apparatus based on the transmitted data.

In some embodiments, the remote computing device can be configured to identify an event at the surface cleaning apparatus based on the transmitted data, and at least one change to the operation of the surface cleaning apparatus based on the identified event or the transmitted data. In this case, the remote computing device can transmit appropriate instructions to the controller of the surface cleaning apparatus to carry out the operational change. In other embodiments, the remote computing device can be configured to identify an event at the surface cleaning apparatus based on the transmitted data, and the controller makes at least one change to the operation of the surface cleaning apparatus based on the identified event. In this case, the identified event may be transmitted to from the remote computing device to the controller. In still other embodiments, the remote computing device can be configured to identify an event at the surface cleaning apparatus based on the transmitted data, and the controller makes at least one change to the operation of the surface cleaning apparatus based on the transmitted data. In this case, the controller can carry out the operation change without input from the remote computing device.

In one embodiment, the plurality of sensors includes at least one of: a tank full sensor, a turbidity sensor, a floor type sensor, a pump pressure sensor, a recovery system or filter status sensor, a wheel rotation sensor, an acoustic sensor or microphone, a usage sensor, a soil sensor, or an accelerometer.

In one embodiment, the remote computing device is configured to store a cleaning path based on the distance cleaned, the area cleaned, and/or the rotations per minute for the wheel. The remote computing device can transfer the cleaning path to an autonomous surface cleaning device, and the autonomous surface cleaning device can be configured to traverse the cleaning path during subsequent cycles of operation.

According to another aspect of the invention, a surface cleaning apparatus includes a base adapted for contacting a surface to be cleaned, an electrically powered suction source comprising a vacuum motor, a recovery tank fluidly coupled to the suction source, an electrically powered pump, a supply tank fluidly coupled to the pump, a dirt sensor configured to generate dirt sensor data during a cycle of operation of the surface cleaning apparatus, the dirt sensor data correlating to a dirtiness of the surface to be cleaned, a controller configured to process the dirt sensor data generated by the dirt sensor and to transmit a pump control signal to the pump to adjust a flow rate of cleaning fluid from the pump based on the dirt sensor data generated by the dirt sensor, and a connectivity component configured to wirelessly transmit the dirt sensor data to a remote computing device, wherein the remote computing device is configured to identify, based on the transmitted dirt sensor data, a dirty floor event at the surface cleaning apparatus and/or a change in the flow rate of cleaning fluid from the pump.

According to yet another aspect of the invention, a method of controlling flow rate for a surface cleaning apparatus is provided, the method including sensing a dirtiness of the surface to be cleaned with a dirt sensor on-board the surface cleaning apparatus, generating a pump control signal that instructs the pump to change a flow rate of cleaning fluid from the pump based on the dirt sensor data, transmitting the pump control signal to the pump to change the flow rate of cleaning fluid from the pump, transmitting the dirt sensor data to a remote computing device, receiving the dirt sensor data at the remote computing device, processing the received dirt sensor data to identify, based on the transmitted dirt sensor data, a dirty floor event at the surface cleaning apparatus and/or a change in the flow rate of cleaning fluid from the pump, and providing to a user of the surface cleaning apparatus, via the remote computing device, a notification of the dirty floor event and/or the change in the flow rate.

These and other features and advantages of the present disclosure will become apparent from the following description of particular embodiments, when viewed in accordance with the accompanying drawings and appended claims.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and may be practiced or carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components. Any reference to claim elements as "at least one of X, Y and Z" is meant to include any one of X, Y or Z individually, and any combination of X, Y and Z, for example, X, Y, Z; X, Y; X, Z; and Y, Z.

BRIEF DESCRIPTION OF THE DRAWINGS

The invention will now be described with respect to the drawings in which.

DESCRIPTION OF EMBODIMENTS OF THE INVENTION

The present disclosure generally relates to a surface cleaning apparatus, which may be in the form of a multi-surface vacuum cleaner, an autonomous floor cleaner, an unattended portable extractor, an upright deep cleaner, or a handheld extractor. In one aspect of the present disclosure, a controller coupled to a set of sensors collects and transmits data to a remote computing device.

The functional systems of the surface cleaning apparatus can be arranged into any desired configuration, such as an upright device having a base and an upright body for directing the base across the surface to be cleaned, a canister device having a cleaning implement connected to a wheeled base by a vacuum hose, a portable device adapted to be hand carried by a user for cleaning relatively small areas, or a commercial device. Any of the aforementioned cleaners can be adapted to include a flexible vacuum hose, which can form a portion of the working air conduit between a nozzle and the suction source. As used herein, the term "multi-surface wet vacuum cleaner" includes a vacuum cleaner that can be used to clean hard floor surfaces such as tile and hardwood and soft floor surfaces such as carpet.

Figure 1:
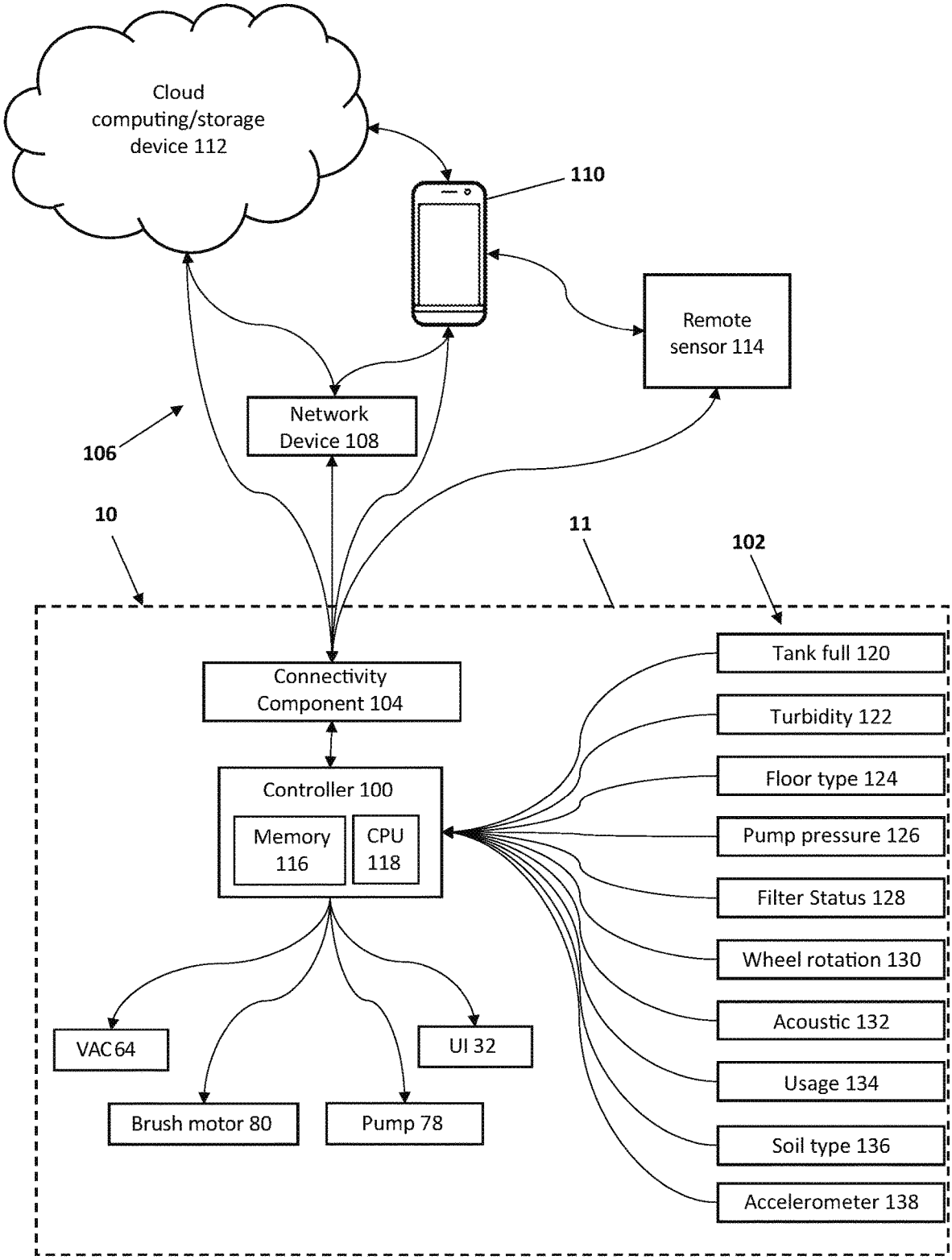
FIG. 1 is a schematic view of a system including a connected surface cleaning apparatus, according to one embodiment of the invention.

FIG. 1 is a schematic view of a system for including a connected surface cleaning apparatus 10, according to one embodiment of the invention. The surface cleaning apparatus 10 can include a controller 100 coupled to one or more sensors 102, each sensor provided on or within a housing 11 of the apparatus 10, such housing 11 optionally including a base (see, for example, FIG. 2, element 14) or an upright assembly (see, for example, FIG. 2, element 12), or any other housing or housings suitable for enclosing one or more components of the surface cleaning apparatus 10. The controller 100 can be coupled to or integrated with a connectivity component 104. The controller 100 is configured to collect data provided by the one or more sensors 102 and the connectivity component 104 is configured to transmit the data to one or more remote computing devices 106. Non-limiting examples of the one or more remote computing devices 106 include a network device 108, a mobile device 110, or a cloud computing/storage device 112.

The controller 100 can be provided with a memory 116 and a central processing unit (CPU) 118 and may be preferably embodied in a microcontroller. The memory 116 can be used for storing control software to be executed by the CPU 118 in completing a cleaning cycle of operation. For example, the memory 116 can store one or more preprogrammed cleaning cycles that includes instructions to gather and transmit data collected during or after the operation of the surface cleaning apparatus 10.

The controller 100 can receive input from one or more sensors, including the onboard sensors 102 and/or a remote sensor 114. Each of the one or more onboard sensors 102 is configured to detect events or changes related to the operation of the surface cleaning apparatus 10 or its operating environment and send the information to the controller 100. Non-limiting examples of the one or more onboard sensors 102 include a tank full sensor 120, a turbidity sensor 122, a floor type sensor 124 (also referred to as a floor condition sensor), a pump pressure sensor 126, a recovery system or filter status sensor 128, a wheel rotation sensor 130, an acoustic sensor 132, a usage sensor 134, a soil sensor 136 and an accelerometer 138. Any one of these sensors, or any combination of these sensors, can be provided on the surface cleaning apparatus 10.

The remote sensor 114 is configured to detect events or changes related to the operating environment of the surface cleaning apparatus 10 and send the information to the controller 100 via the connectivity component 104. The controller 100 is configured to collect the information provided by the remote sensor 114, optionally along with information provided by the on-board sensors 102, and the connectivity component 104 is configured to transmit the information to one or more remote computing devices 106 (FIG. 1). Some non-limiting examples of the one or more remote sensors 114 includes an acoustic sensor, a wheel rotation sensor, a floor type sensor, or a soil sensor. In one embodiment, the remote sensor 114 can be provided on a second surface cleaning apparatus. In another embodiment, the remote sensor 114 can be provided on a hand-held stain detection device.

The controller 100 can be configured to transmit output signals to controlled components of the surface cleaning apparatus 10 and execute a cleaning cycle of operation. Non-limiting examples of the controlled components that can receive signals from the controller 100 include a vacuum motor 64, a brush motor 80, a pump 78, and a user interface (UI) 32. The controlled components are provided on or within the housing 11 of the apparatus 10.

The connectivity component 104 is configured to transmit data gathered by the controller 100 to one or more of the remote computing devices 106. The connectivity component 104 can contain or incorporate any wireless or networking technology and be configured with any protocol useful for wireless communication with the remote computing devices 106, including, but not limited to, Bluetooth, Bluetooth Low Energy (BLE), Bluetooth 5, IEEE 802.11b (Wi-Fi), IEEE 802.11ah (Wi-Fi HaLow), Wi-Fi Direct, Wi-Fi EasyMesh, Worldwide Interoperability for Microwave Access (WiMAX), near-field communication (NFC), radio-frequency identification (RFID), IEEE 802.15.4 (Zigbee), Z-Wave, ultrawideband communications (UWB), Light-Fidelity (Li-Fi), Long Term Evolution (LTE), LTE Advanced, low-power wide-area networking (LPWAN), power-line communication (PLC), Sigfox, Neul, etc. The connectivity component 104 can operate in any frequency or bandwidth useful for transmitting data gathered by the controller 100 or receiving data from one or more remote computing devices 106 including, but not limited to, frequencies within the industrial, scientific, medical (ISM) bands. Additionally, the connectivity component 104 can be configured as a wireless repeater or a wireless range extender. For example, an autonomous floor cleaner or an associated docking station including connectivity component 104 can provide or enhance wireless access coverage.

The cloud computing/storage device 112 is configured to receive data transmitted by the connectivity component 104 and to process and store information based on the received data. The cloud computing/storage device 112 can include a plurality of devices that are interconnected with shared and configurable resources that are provisioned with minimal management. The plurality of devices that form the cloud computing/storage device 112 can have any number of networked devices useful for processing, accessing and storing data including, but not limited to, information processing systems, associated computers, servers, storage devices and other processing devices. The plurality of devices can be coupled by any wired or wireless connection useful for sharing data and resources, including, but not limited to, any number or combination of, an ad-hoc network, a local area network (LAN), a wide area network (WAN), an Internet area network (IAN), the Internet, etc.

The mobile device 110, such as a smartphone, is a multi-purpose mobile computing device configured for electronic communication with the connectivity component 104 of the surface cleaning device 10 and the cloud computing/storage device 112. As used herein, the term smartphone includes a mobile phone that performs many of the functions of a computer, typically having a touchscreen interface, Internet access, and an operating system capable of running downloaded applications. While embodiments of the invention are discussed herein relative to a smartphone providing the mobile device 110, it is understood that other portable mobile devices are suitable, such as, but not limited to, a tablet, a wearable computer such as a smartwatch, a voice-command control device such as a smart speaker, or a dedicated remote-control device.

The network device 108 mediates data between the connectivity component 104, the cloud computing/storage device 112, and the mobile device 110. The network device 108 can be any device useful for forwarding data packets on a computing network including, but not limited to, gateways, routers, network bridges, modems, wireless access points, networking cables, line drivers, switches, hubs, and repeaters; and may also include hybrid network devices such as multilayer switches, protocol converters, bridge routers, proxy servers, firewalls, network address translators, multiplexers, network interface controllers, wireless network interface controllers, ISDN terminal adapters and other related hardware.

Figure 2:
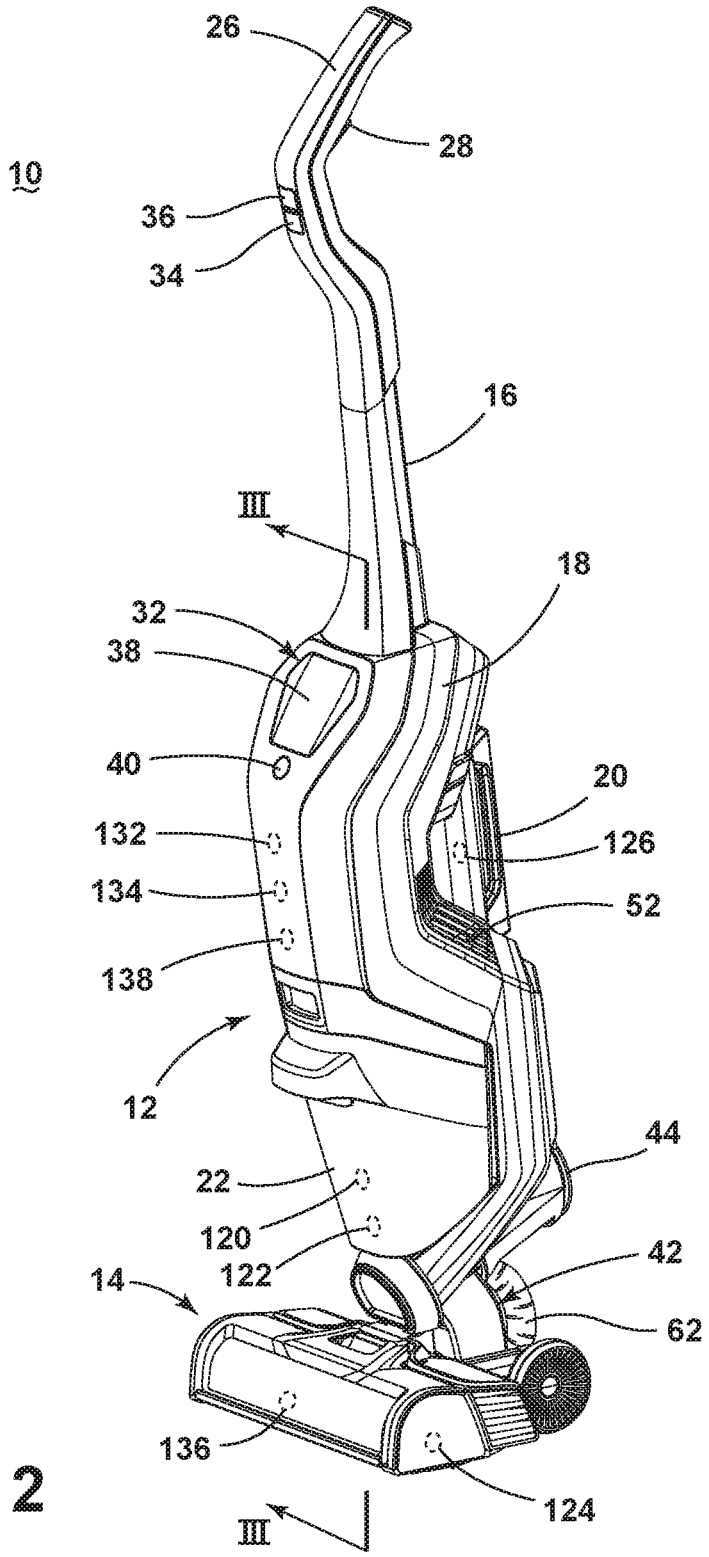
FIG. 2 is a perspective view of one embodiment of the surface cleaning apparatus for the system of FIG. 1.

FIG. 2 is a perspective view illustrating one non-limiting example of a surface cleaning apparatus that can include the systems and functions described in FIG. 1. As shown, the surface cleaning apparatus is in the form of an upright multi-surface wet vacuum cleaner 10, according to one embodiment of the invention. The upright multi-surface wet vacuum cleaner having a housing that includes an upright handle assembly or body 12 and a cleaning head or base 14 mounted to or coupled with the upright body 12 and adapted for movement across a surface to be cleaned. For purposes of description related to the figures, the terms "upper," "lower," "right," "left," "rear," "front," "vertical," "horizontal," "inner," "outer," and derivatives thereof shall relate to the invention as oriented in FIG. 2 from the perspective of a user behind the multi-surface wet vacuum cleaner 10, which defines the rear of the multi-surface wet vacuum cleaner 10. However, it is to be understood that the invention may assume various alternative orientations, except where expressly specified to the contrary.

The upright body 12 can comprise a handle 16 and a frame 18. The frame 18 can comprise a main support section supporting at least a supply tank 20 and a recovery tank 22, and may further support additional components of the body 12. The surface cleaning apparatus 10 can include a fluid delivery or supply pathway, including and at least partially defined by the supply tank 20, for storing cleaning fluid and delivering the cleaning fluid to the surface to be cleaned and a recovery pathway, including and at least partially defined by the recovery tank 22, for removing the spent cleaning fluid and debris from the surface to be cleaned and storing the spent cleaning fluid and debris until emptied by the user.

The handle 16 can include a hand grip 26 and a trigger 28 mounted to the hand grip 26, which controls fluid delivery from the supply tank 20 via an electronic or mechanical coupling with the tank 20. The trigger 28 can project at least partially exteriorly of the hand grip 26 for user access. A spring (not shown) can bias the trigger 28 outwardly from the hand grip 26. Other actuators, such as a thumb switch, can be provided instead of the trigger 28.

The surface cleaning apparatus 10 can include at least one user interface through which a user can interact with the surface cleaning apparatus 10. The at least one user interface can enable operation and control of the apparatus 10 from the user's end, and can also provide feedback information from the apparatus 10 to the user. The at least one user interface can be electrically coupled with electrical components, including, but not limited to, circuitry electrically connected to various components of the fluid delivery and recovery systems of the surface cleaning apparatus 10.

The surface cleaning apparatus 10 can include at least one user interface 32 through which a user can interact with the surface cleaning apparatus 10. The user interface 32 can enable operation and control of the apparatus 10 from the user's end and can provide feedback information from the apparatus 10 to the user. The user interface 32 can be electrically coupled with electrical components, including, but not limited to, circuitry electrically connected to various components of the fluid delivery and recovery systems of the surface cleaning apparatus 10. As shown, the user interface 32 can include a display 38, such as, but not limited to, an LED matrix display or a touchscreen. The user interface 32 can optionally include at least one input control 40, which can be adjacent the display 38 or provided on the display 38. One example of a suitable user interface is disclosed in International Publication Number WO2020/082066, published Apr. 23, 2020, which is incorporated herein by reference in its entirety.

In the illustrated embodiment, the user interface 32 includes one or more input controls 34, 36 separate from the display 38. The input controls 34, 36 are in register with a printed circuit board (PCB, not shown) within the hand grip 26. In one embodiment, one input control 34 is a power input control that controls the supply of power to one or more electrical components of the apparatus 10. Another input control 36 is a cleaning mode input control that cycles the apparatus 10 between a hard floor cleaning mode and a carpet cleaning mode, as described in further detail below. One or more of the input controls 34, 36 can comprise a button, trigger, toggle, key, switch, or the like, or any combination thereof. In one example, one or more of the input controls 34, 36 can comprise a capacitive button.

A moveable joint assembly 42 can be formed at a lower end of the frame 18 and moveably mounts the base 14 to the upright body 12. In the embodiment shown herein, the upright body 12 can pivot up and down about at least one axis relative to the base 14. The joint assembly 42 can alternatively comprise a universal joint, such that the upright body 12 can pivot about at least two axes relative to the base 14. Wiring and/or conduits can optionally supply electricity, air and/or liquid (or other fluids) between the base 14 and the upright body 12, or vice versa, and can extend though the joint assembly 42.

The upright body 12 can pivot, via the joint assembly 42, to an upright or storage position, an example of which is shown in FIG. 2, in which the upright body 12 is oriented substantially upright relative to the surface to be cleaned and in which the apparatus 10 is self-supporting, i.e. the apparatus 10 can stand upright without being supported by something else. A locking mechanism (not shown) can be provided to lock the joint assembly 42 against movement about at least one of the axes of the joint assembly 42 in the storage position, which can allow the apparatus 10 to be self-supporting. From the storage position, the upright body 12 can pivot, via the joint assembly 42, to a reclined or use position (not shown), in which the upright body 12 is pivoted rearwardly relative to the base 14 to form an acute angle with the surface to be cleaned. In this position, a user can partially support the apparatus by holding the hand grip 26. A bumper 44 can be provided on a rear side of the upright body 12, for example at a lower rear side of the frame 18 and/or below the supply tank 20.

Figure 3:
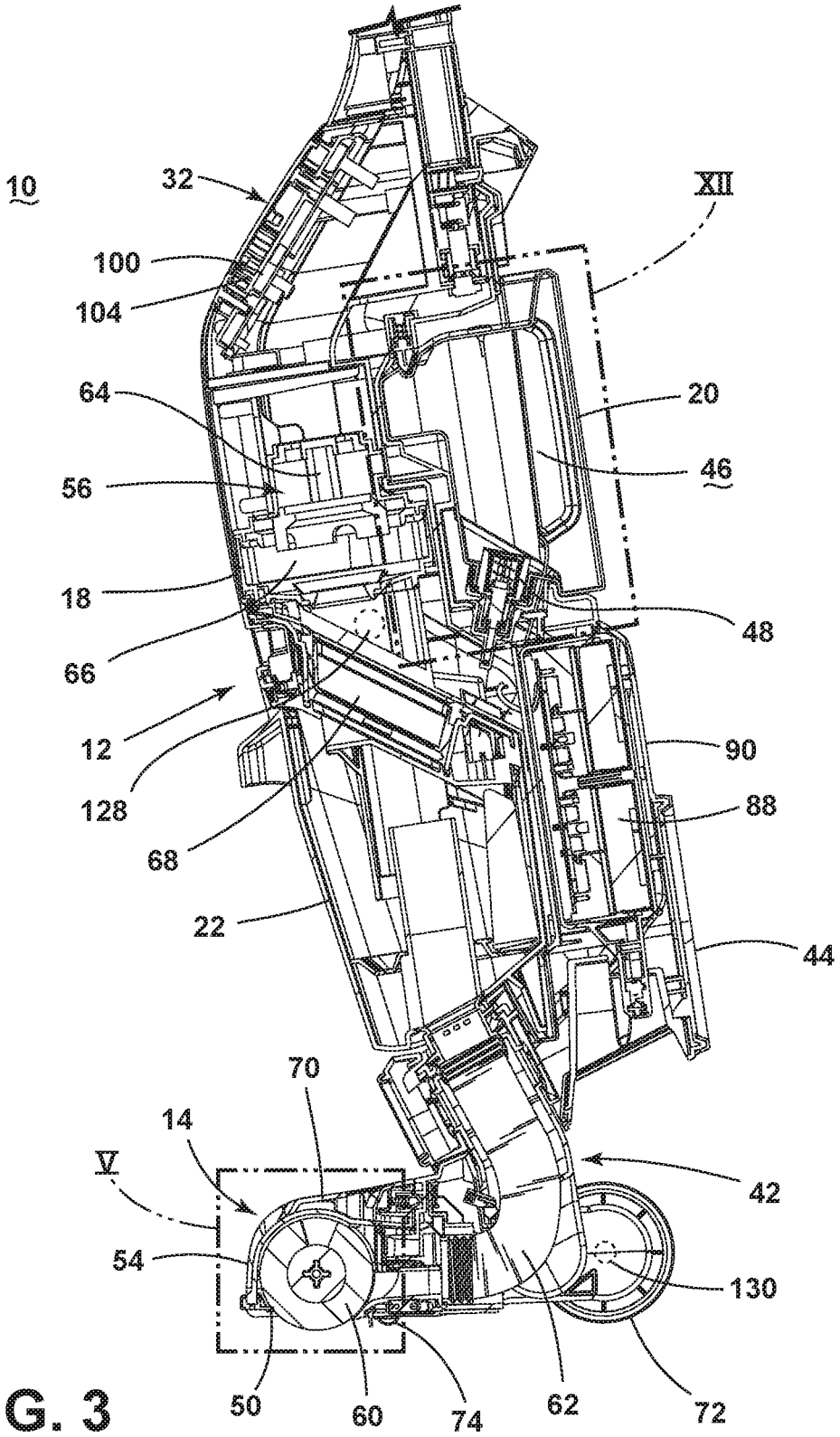
FIG. 3 is a cross-sectional view of the surface cleaning apparatus through line III-III of FIG. 2.

FIG. 3 is a cross-sectional view of the surface cleaning apparatus 10 through line III-III FIG. 2. The supply and recovery tanks 20, 22 can be provided on the upright body 12. The supply tank 20 can be mounted to the frame 18 in any configuration. In the present embodiment, the supply tank 20 can be removably mounted at the rear of the frame 18 such that the supply tank 20 partially rests in the upper rear portion of the frame 18 and is removable from the frame 18 for filling. The recovery tank 22 can be mounted to the frame 18 in any configuration. In the present embodiment, the recovery tank 22 can be removably mounted at the front of the frame 18, below the supply tank 20, and is removable from the frame 18 for emptying.

The fluid delivery system is configured to deliver cleaning fluid from the supply tank 20 to a surface to be cleaned, and can include, as briefly discussed above, a fluid delivery or supply pathway. The cleaning fluid can comprise one or more of any suitable cleaning fluids, including, but not limited to, water, compositions, concentrated detergent, diluted detergent, etc., and mixtures thereof. For example, the fluid can comprise a mixture of water and concentrated detergent.

The supply tank 20 includes at least one supply chamber 46 for holding cleaning fluid and a supply valve assembly 48 controlling fluid flow through an outlet of the supply chamber 46. Alternatively, supply tank 20 can include multiple supply chambers, such as one chamber containing water and another chamber containing a cleaning agent. For a removable supply tank 20, the supply valve assembly 48 can mate with a receiving assembly on the frame 18 and can be configured to automatically open when the supply tank 20 is seated on the frame 18 to release fluid to the fluid delivery pathway.

The recovery system is configured to remove spent cleaning fluid and debris from the surface to be cleaned and store the spent cleaning fluid and debris on the surface cleaning apparatus 10 for later disposal, and can include, as briefly discussed above, a recovery pathway. The recovery pathway can include at least a dirty inlet 50 and a clean air outlet 52 (FIG. 1). The pathway can be formed by, among other elements, a suction nozzle 54 defining the dirty inlet, a suction source 56 in fluid communication with the suction nozzle 54 for generating a working air stream, the recovery tank 22, and at least one exhaust vent defining the clean air outlet 52.

The suction nozzle 54 can be provided on the base 14 can be adapted to be adjacent the surface to be cleaned as the base 14 moves across a surface. A brushroll 60 can be provided adjacent to the suction nozzle 54 for agitating the surface to be cleaned so that the debris is more easily ingested into the suction nozzle 54. While a horizontally-rotating brushroll 60 is shown herein, in some embodiments, dual horizontally-rotating brushrolls, one or more vertically-rotating brushrolls, or a stationary brush can be provided on the apparatus 10.

The suction nozzle 54 is further in fluid communication with the recovery tank 22 through a conduit 62. The conduit 62 can pass through the joint assembly 42 and can be flexible to accommodate the movement of the joint assembly 42.

The suction source 56, which can be a motor/fan assembly including a vacuum motor 64 and a fan 66, is provided in fluid communication with the recovery tank 22. The suction source 56 can be positioned within a housing of the frame 18, such as above the recovery tank 22 and forwardly of the supply tank 20. The recovery system can also be provided with one or more additional filters upstream or downstream of the suction source 56. For example, in the illustrated embodiment, a pre-motor filter 68 is provided in the recovery pathway downstream of the recovery tank 22 and upstream of the suction source 56. A post-motor filter (not shown) can be provided in the recovery pathway downstream of the suction source 56 and upstream of the clean air outlet 52.

The base 14 can include a base housing 70 supporting at least some of the components of the fluid delivery system and fluid recovery system, and a pair of wheels 72 for moving the apparatus 10 over the surface to be cleaned. The wheels 72 can be provided on rearward portion of the base housing 70, rearward of components such as the brushroll 60 and suction nozzle 54. A second pair of wheels 74 can be provided on the base housing 70, forward of the first pair of wheels 72.

The vacuum cleaner 10 can be configured for connection to an electrical power source, such as a residential power supply via a power cord (not shown), or configured for cordless operation via battery 88 as shown. The battery 88 can be located within a battery housing 90 located on the upright body 12 or base 14 of the apparatus, which can protect and retain the battery 88 on the apparatus 10. In the illustrated embodiment, the battery housing 90 is provided on the frame 18 of the upright body 12.

With reference to FIGS. 2-3, the multi-surface wet vacuum cleaner 10 can include the controller 100 coupled to one or more of the sensors of FIG. 1, each sensor provided on or within the base 14 or on or within the upright assembly 12. The sensors can include, but are not limited to, the tank full sensor 120, turbidity sensor 122, floor type sensor 124, pump pressure sensor 126, recovery system or filter status sensor 128, wheel rotation sensor 130, acoustic sensor 132, usage sensor 134, soil sensor 136, and/or accelerometer 138. Any one of these sensors, or any combination of these sensors, can be provided on the multi-surface wet vacuum cleaner 10. The sensors 120-138 are shown schematically in FIGS. 2-3, and the configuration, location, and number of each sensor 120-138 can vary.

Each sensor 120-138 is configured to generate data related to the operation of the apparatus 10 or its operating environment and to send the data to the controller 100. The controller 100 can be coupled to or integrated with the connectivity component 104. The controller 100 is configured to collect the information provided by the sensors 120-138, and the connectivity component 104 is configured to transmit the information to one or more remote computing devices 106 (FIG. 1). The remote computing device 106 is configured to identify an event and/or change in the cycle of operation of the apparatus 10 based on the transmitted data. In some embodiments, the connectivity component 104 can also receive information provided by the remote sensor 114 (FIG. 1) and this sensor information is collected by the controller 100, and optionally transmitted to one or more of the other remote computing devices 106.

The tank full sensor 120 generates data related to the presence of fluid in the recovery tank 22, and sends this information to the controller 100. Optionally, the sensor 120 can generate data that correlates to a presence of fluid at a predetermined level within the recovery tank 22, and provide this information to the controller 100. The event identified by the remote computing device 106 can be a volume of fluid in the recovery tank 22 exceeding a predetermined capacity or level within the recovery tank 22. In response, the change in operation of the apparatus 10 can be to power off the apparatus 10 (i.e. turn off the supply of power to the electrical components of the apparatus 10) until the recovery tank 22 has been emptied. The user may be notified of the event via the user interface 32 or via an application configured on a portable electronic device.

Various tank full sensors 120 are possible. In one embodiment, the tank full sensor 120 comprises an infrared transmitter and an infrared receiver, each disposed on an outer surface of the recovery tank 22 and configured such that the infrared receiver absorbs an infrared signal emitted by the infrared transmitter when fluid in the recovery tank 22 refracts the infrared signal. Additional details of one embodiment of the tank full sensor 120 are provided below (see FIGS. 9-10).

The turbidity sensor 122 generates data related to the turbidity of the fluid within the recovery tank 22, and sends this information to the controller 100. Optionally, the sensor 122 can generate data that correlates to a presence of particles suspended in a fluid within the recovery tank 22. The event identified by the remote computing device 106 can be the detection of increasing turbidity indicating a severely dirty floor, such as determined that turbidity has increased above a predetermined turbidity threshold or has increased at a rate above a predetermined rate threshold. In response, the change in operation of the apparatus 10 can be increasing the flow rate of cleaning fluid and/or increasing brushroll speed to maintain effective cleaning. The reverse case can also occur, where less flow or brushroll speed is needed because of light soil levels on the floor resulting in lower turbidity. The user may be notified of the event via the user interface 32 or via an application configured on a portable electronic device.

Various turbidity sensors 122 are possible. Optionally, the turbidity sensor 122 comprises an infrared transmitter and an infrared receiver, each disposed on an outer surface of the recovery tank 22 and configured such that the infrared receiver absorbs an infrared signal emitted by the infrared transmitter when fluid in the recovery tank 22 refracts the infrared signal. As yet another embodiment, the infrared transmitter can be an infrared light emitting device and the infrared receiver can be a photodiode, and the generated data can include a measurement of the intensity of the absorbed infrared signal. Additional details of one embodiment of the turbidity sensor 122 are provided below (see FIGS. 9-10).

The floor type sensor 124 generates data related to a type of surface being contacted by the base 14 and sends this information to the controller 100. Optionally, the sensor 124 can generate data that correlates to acoustic energy reflected by a surface being contacted by the base 14. The event identified by the remote computing device 106 can be a determination of a change in the floor type being cleaned (i.e. moving from a hard floor to carpet or vice versa). The change in operation of the apparatus 10 can be an adjustment of the flow rate of cleaning fluid or brushroll speed according to the new floor type. For example, if the sensor data corresponds to moving from a hard floor to carpet, flow rate and/or brushroll speed can be increased to effectively clean the carpet. If the sensor data corresponds to moving from carpet to a hard floor, flow rate and/or brushroll speed can be decreased to effectively clean and prevent damage to the hard floor. The user may be notified of the event via the user interface 32 or via an application configured on a portable electronic device.

Various floor type sensors 124 are possible. The floor type sensor 124 can comprise any one or combination of known sensors, such as, for example, an ultrasonic transducer, optical, acoustic, or mechanical sensor. Optionally, the floor type sensor 124 can be configured to determine whether the type of surface being contacted by the base 14 is carpet, tile, or wood. Optionally, the floor type sensor 124 can determine that the base 14 is not contacting a surface (i.e. that the base 14 or entire apparatus 10 has been lifted out of contact with a surface). Additional details of one embodiment of the floor type sensor 124 are provided below (see FIGS. 6-8).

The pump pressure sensor 126 generates data related to an absence of fluid in the supply tank 20 and sends this information to the controller 100. Optionally, the sensor 126 can generate data that correlates to differential or gauge pressure indicative of an outlet pressure of the pump 78. From this data, it can be determined when the supply tank 20 is empty, and the event identified by the remote computing device 106 can be an empty supply tank event. The change in operation of the apparatus 10 can be to power off the apparatus 10 (i.e. turn off the supply of power to the electrical components of the apparatus 10) until the supply tank 20 has been refilled in order to avoid mistakenly cleaning an area without any cleaning fluid. The user may be notified of the event via the user interface 32 or via an application configured on a portable electronic device. Various pump pressure sensors 126 are possible. Additional details of one embodiment of the pump pressure sensor 126 are provided below (see FIG. 11).

The recovery system or filter status sensor 128 generates data related to pressure in the air pathway and sends this information to the controller 100. Optionally, the sensor 128 can generate data that correlates to pressure in the air pathway and can provide this information to the controller 100. The event identified by the remote computing device 106 can be an operational status of the vacuum motor 64, the presence of a filter (i.e. the pre-motor filter 68 or post-motor filter) in the recovery pathway, the presence of the recovery tank 22 in the recovery pathway, an air flow rate through a filter (i.e. the pre-motor filter 68 or post-motor filter), or any combination thereof. The change in operation of the apparatus 10 can be to power off the apparatus 10 (i.e. turn off the supply of power to the electrical components of the apparatus 10) until the filter is cleaned or replaced, or the recovery tank 22 has been emptied or replaced. The user may be notified of the event via the user interface 32 or via an application configured on a portable electronic device.

Various filter status sensors 128 are possible. Optionally, the filter status sensor 128 comprises a pressure transducer, and the identified event is a determination of a percentage of blockage of air through a filter (i.e. the pre-motor filter 68 or post-motor filter). Additional details of one embodiment of the filter status sensor 128 are provided below (see FIG. 12).

The wheel rotation sensor 130 generates data related to rotation of one or more of the wheels 72, 74, and sends this information to the controller 100. Optionally, the sensor 130 can generate data that correlates to the number of revolutions of the wheel and provide this information to the controller 100. The event identified by the remote computing device 106 can be a determination of a distance cleaned, an area cleaned, a rotations per minute for the wheel 72, 74, or any combination thereof. The change in operation of the apparatus 10 can be providing a notification to the user that preventative maintenance or other service is required and/or powering off the apparatus 10 until the maintenance or service has been performed. In one embodiment, the notification may recommend cleaning the brushroll 60 and/or filter 68 after a predetermined first event, which may be a predetermined distance cleaned or area cleaned, and the notification may recommend replacing the brushroll 60 and/or filter after a predetermined second event, which may be a predetermined distance cleaned or area cleaned that is greater than that for the first event. The user may be notified of the event via the user interface 32 or via an application configured on a portable electronic device.

Various wheel rotation sensors 130 are possible. Optionally, the wheel rotation sensor 130 is a Hall Effect sensor, and the wheel 72, 74 includes a magnet. In other embodiments, the wheel rotation sensor 130 may include alternative sensor components, such as, for example, a brush-contact switch, a magnetic reed switch, an optical switch, or a mechanical switch. Additional details of one embodiment of the wheel rotation sensor 130 are provided below (see FIG. 13).

The acoustic sensor 132 generates data related to a cycle of operation of the apparatus 10 or the environment in which the apparatus 10 is operating and sends this information to the controller 100. Optionally, the sensor 132 can generate data that correlates to audible noise generated by the apparatus 10 and/or the surrounding environment and can provide this information to the controller 100. The event identified by the remote computing device 106 can be a clogged filter (i.e. the pre-motor filter 68 or post-motor filter), a missing filter (i.e. the pre-motor filter 68 or post-motor filter), a type of surface being contacted by the base 14, or environmental events such as a baby's cry, a ringing door bell, a barking pet, or a ringing phone. In the event of a clogged or missing filter, the change in operation of the apparatus 10 can be to power off the apparatus 10 until the filter is cleaned or replaced in order to avoid mistakenly cleaning an area with low suction power. In the event of an identified or new floor type, the change in operation of the apparatus 10 can be an adjustment of the flow rate of cleaning fluid or brushroll speed according to the floor type. In the event of a baby's cry, a ringing door bell, a barking pet, or a ringing phone the change in operation of the apparatus 10 can be to power off the apparatus 10 so that the sound of the environmental event is not obstructed by the operational noise of the apparatus 10. The user may be notified of the event via the user interface 32 or via an application configured on a portable electronic device. Various acoustic sensors 132 are possible. Optionally, the acoustic sensor 132 is a microphone. Additional details of one embodiment of the acoustic sensor 132 are provided below (see FIG. 14).

The usage sensor 134 generates data related to usage or operating time of the apparatus 10 and sends this information to the controller 100. Optionally, the sensor 134 can generate data that correlates to an elapsed time and provide this information to the controller 100. The event identified by the remote computing device 106 can be a duration of operation of the apparatus 10, including a single cycle operating time or a lifetime operating time, a date on which the apparatus 10 is operated, and/or a time of day at which the apparatus 10 is operated. The change in operation of the apparatus 10 can be can be providing a notification to the user that preventative maintenance or other service is required and/or powering off the apparatus 10 until the maintenance or service has been performed. In one embodiment, the notification may recommend cleaning the brushroll 60 and/or filter 68 after a predetermined first event, which may be a first operating time, and the notification may recommend replacing the brushroll 60 and/or filter after a predetermined second event, which may be a second operating time that is greater than the first operating time. In one non-limiting example, the first operating time may be 10 hours, i.e. the notification may recommend cleaning the brushroll 60 and/or filter 68 after 10 hours of total operating time, and the second operating time may be 50 hours, i.e. the notification may recommend replacing the brushroll 60 and/filter 68 after 50 hours of total operating time.

Various usage sensors 134 are possible. In one embodiment, the usage sensor 134 can comprise a vacuum motor sensor circuit configured to generate data related to the operating time of the vacuum motor 64, under the assumption that the apparatus 10 is being used for cleaning when the vacuum motor 64 is energized.

In one method, usage sensor 134 can monitor the operating time of the vacuum motor 64, and send this information to the controller 100. Optionally, the sensor 134 can generate data that correlates to an elapsed time the vacuum motor 64 is "on", and provide this information to the controller 100. Signals from the controller 100 are used to determine when the vacuum motor 64 is on or off. The event identified by the remote computing device 106 can be a duration of operation of the vacuum motor 64, i.e. how long the vacuum motor 64 is "on," including a single cycle usage time or a lifetime usage time, a date on which the vacuum motor 64 is "on", and/or a time of day at which the vacuum motor 64 is "on". From usage information of the vacuum motor 64, usage information of the apparatus 10 can be extrapolated or estimated, including a duration of operation of the apparatus 10, including a single cycle operating time or a lifetime operating time, a date on which the apparatus 10 is operated, and/or a time of day at which the apparatus 10 is operated. These events can used as an additional input for determining when preventative maintenance is needed or for warranty purposes. The change in operation of the apparatus 10 can be providing a notification to the user that preventative maintenance is required, such as displaying the notification on the user interface 32, and/or powering off the apparatus 10 (i.e. turn off the supply of power to the electrical components of the apparatus 10) until preventative maintenance has been performed. The remote device 106 can use the usage data to determine when to send notifications through the mobile application (e.g., a notification to buy more formula, a notification to clean the filter, a notification to replace the brushroll, etc.)

In one embodiment, the usage sensor 134 can further monitor the operating mode of the apparatus 10. As disclosed above, the input control 36 can cycle the apparatus 10 between a hard floor cleaning mode and a carpet cleaning mode. The output from the controller 100 adjusts the speed of the pump 78 to generate the desired flow rate depending on the mode selected. For instance, in the hard floor cleaning mode, the flow rate is less than in the carpet cleaning mode. In one non-limiting example, in the hard floor cleaning mode the flow rate is approximately 50 ml/min and in the carpet cleaning mode the flow rate is approximately 100 ml/min. Signals from the controller 100 are used to determine when the unit is in the hard floor cleaning mode or the carpet cleaning mode.

In another embodiment, the usage sensor 134 can comprise a pump motor sensor circuit configured to generate data related to the operating time of the pump 78, under the assumption that the apparatus 10 is being used for wet cleaning when the pump 78 is energized.

In one method, usage sensor 134 can monitor the operating time of the pump 78, and send this information to the controller 100. Optionally, the sensor 134 can generate data that correlates to an elapsed time the pump 78 is "on", and provide this information to the controller 100. Signals from the controller 100 are used to determine when the pump 78 is energized and what duty cycle (low flow or high flow) is being used. The event identified by the remote computing device 106 can be a duration of operation of the pump 78, i.e. how long the pump 78 is "on," including a single cycle usage time or a lifetime usage time, a date on which the pump 78 is "on", and/or a time of day at which the pump 78 is "on." From usage information of the pump 78, usage information of the apparatus 10 can be extrapolated or estimated, including a duration of operation of the apparatus 10, including a single cycle operating time or a lifetime operating time, a date on which the apparatus 10 is operated, and/or a time of day at which the apparatus 10 is operated. For example, the length of the time the pump 78 is on is used together with the nominal specification flow rates to estimate how much cleaning formula is used during a single cycle operating time and/or during a lifetime operating time. The remote device 106 can use the usage data to determine when to send notifications through the mobile application (e.g., a notification to buy more formula, a notification that cleaning formula usage per operating time is excessively high or excessively low, etc.) Optionally, operational data from the pump 78 can be combined with operational data from the vacuum motor 64 to determine overall usage information of the apparatus 10.

The soil sensor 136 generates data related to soil on the surface being contacted by the base 14 or in the surrounding environment, such as the surface in front of the base 14. Optionally, the sensor 136 can generate data that correlates to a type of soil on the surface or a chemical makeup of the soil and provide this information to the controller 100. The event identified by the remote computing device 106 can be the detection of a certain soil type or a change in soil type. The change in operation of the apparatus 10 can be the adjustment of: a flow rate of the pump 78, an agitation duration of the brushroll 60, including an operation duration of the brush motor 80, and/or an operation duration of the vacuum motor 64. The user may be notified of the event via the user interface 32 or via an application configured on a portable electronic device.

Various soil sensors 136 are possible. Optionally, the soil sensor 136 is a near-infrared spectrometer, and the generated data correlates to a spectrum of absorbed light reflected from the surface of the surrounding environment. In one embodiment, the remote computing device 106 is configured to identify a type of stain based on soil information from the controller 100, and transmit information related to the identified stain to a portable electronic device, wherein an application configured on the portable electronic device is configured to display the identified type of stain and display one or more methods of stain mitigation, i.e. stain treatment. A method of stain mitigation or treatment may be recommended based on the identified stain type, optionally also based on an identified floor type or other sensor data. The method of stain mitigation or treatment can include a particular movement pattern, flow rate, solution amount, solution concentration, solution dwell time, brushroll operation time, extraction time, or any combination thereof that is appropriate for the stain.

The accelerometer 138 generates data related to acceleration of the apparatus 10. Optionally, the accelerometer 138 can generate data that correlates to vibrations generated by the apparatus 10 and/or the surrounding environment. The event identified by the remote computing device 106 can be a clogged filter (i.e. the pre-motor filter 68 or post-motor filter), a missing filter (i.e. the pre-motor filter 68 or post-motor filter), a type of surface being contacted by the base 14, a broken belt (i.e. for a belt coupling the brushroll 60 and the brush motor 80), a non-rotating brushroll 60, or any combination thereof. In the event of a clogged or missing filter, the change in operation of the apparatus 10 can be to power off the apparatus 10 until the filter is cleaned or replaced in order to avoid mistakenly cleaning an area with low suction power. In the event of an identified or new floor type, the change in operation of the apparatus 10 can be an adjustment of the flow rate of cleaning fluid or brushroll speed according to the floor type. In the event of a broken belt or non-rotating brushroll 60, the change in operation of the apparatus 10 can be to power off at least the brush motor 80, or the entire apparatus 10. The user may be notified of the event via the user interface 32 or via an application configured on a portable electronic device. Various accelerometers 138 are possible. Additional details of one embodiment of the accelerometer 138 are provided below (see FIG. 15).

Figure 4:
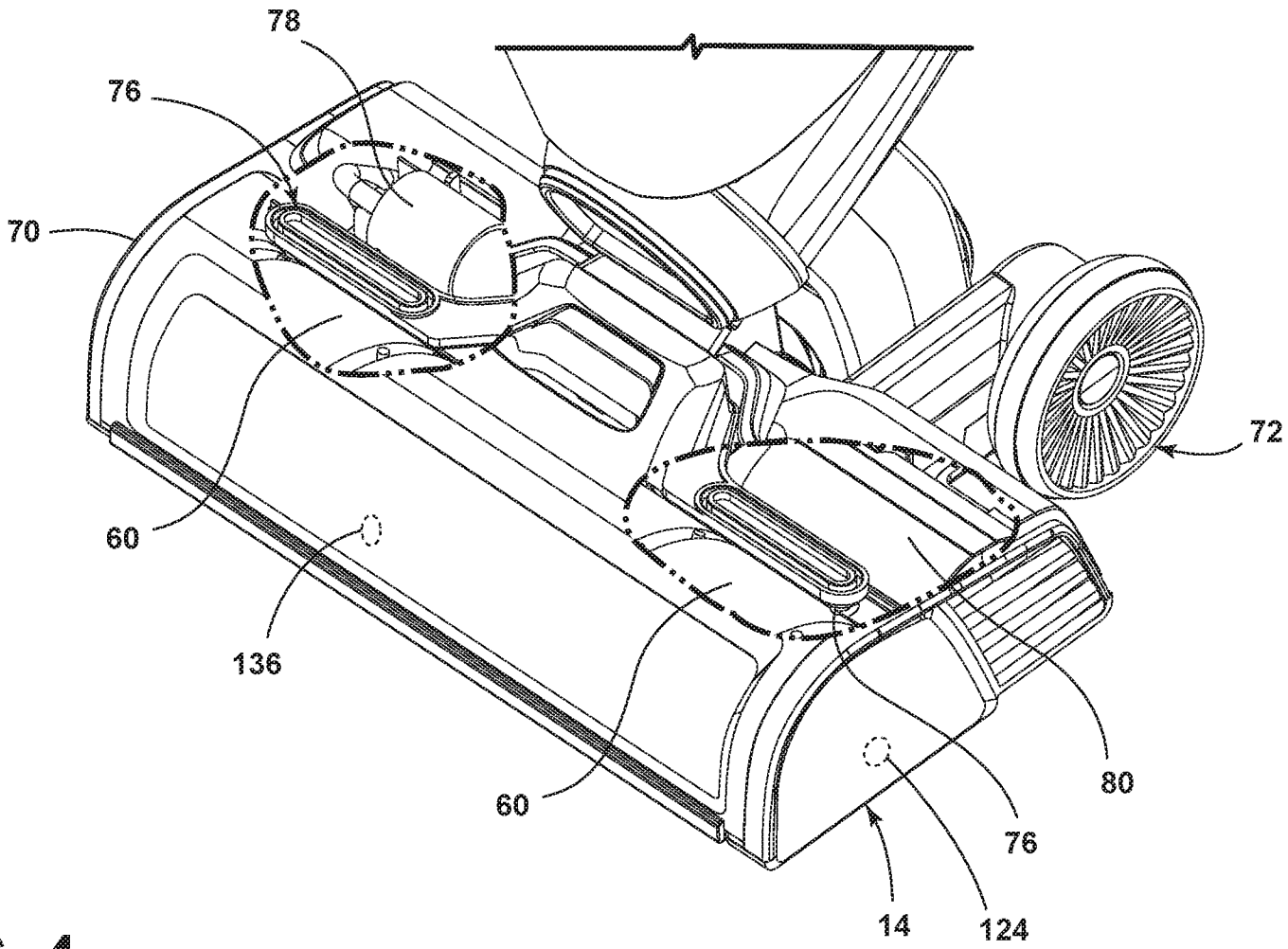
FIG. 4 is a front perspective view of a base of the surface cleaning apparatus of FIG. 2, with portions of the base partially cut away to show internal details.

FIG. 4 is a front perspective view of the base 14, with portions of the base 14 partially cut away to show some internal details of the base 14. In addition to the supply tank 20 (FIG. 3), the fluid delivery pathway can include a fluid distributor 76 having at least one outlet for applying the cleaning fluid to the surface to be cleaned. In one embodiment, the fluid distributor 76 can be one or more spray tips on the base 14 configured to deliver cleaning fluid to the surface to be cleaned directly or indirectly by spraying the brushroll 60. Other embodiments of fluid distributors 76 are possible, such as a spray manifold having multiple outlets or a spray nozzle configured to spray cleaning fluid outwardly from the base 14 in front of the surface cleaning apparatus 10.

The fluid delivery system can further comprise a flow control system for controlling the flow of fluid from the supply tank 20 to the fluid distributor 76. In one configuration, the flow control system can comprise a pump 78 that pressurizes the system. The trigger 28 (FIG. 2) can be operably coupled with the flow control system such that pressing the trigger 28 will deliver fluid from the fluid distributor 76. The pump 78 can be positioned within a housing of the base 14, and is in fluid communication with the supply tank 20 via the valve assembly 48. Optionally, a fluid supply conduit can pass interiorly to joint assembly 42 and fluidly connect the supply tank 20 to the pump 78. In one example, the pump 78 can be a centrifugal pump. In another example, the pump 78 can be a solenoid pump having a single, dual, or variable speed. While shown herein as positioned within the base 14, in other embodiments the pump 78 can be positioned within the upright body 12.

In another configuration of the fluid supply pathway, the pump 78 can be eliminated and the flow control system can comprise a gravity-feed system having a valve fluidly coupled with an outlet of the supply tank 20, whereby when valve is open, fluid will flow under the force of gravity to the fluid distributor 76.

Optionally, a heater (not shown) can be provided for heating the cleaning fluid prior to delivering the cleaning fluid to the surface to be cleaned. In one example, an in-line heater can be located downstream of the supply tank 20, and upstream or downstream of the pump 78. Other types of heaters can also be used. In yet another example, the cleaning fluid can be heated using exhaust air from a motor-cooling pathway for the suction source 56 of the recovery system.

The brushroll 60 can be operably coupled to and driven by a drive assembly including a dedicated brush motor 80 in the base 14. The coupling between the brushroll 60 and the brush motor 80 can comprise one or more belts, gears, shafts, pulleys or combinations thereof. Alternatively, the vacuum motor 64 (FIG. 3) can provide both vacuum suction and brushroll rotation.

Figure 5:
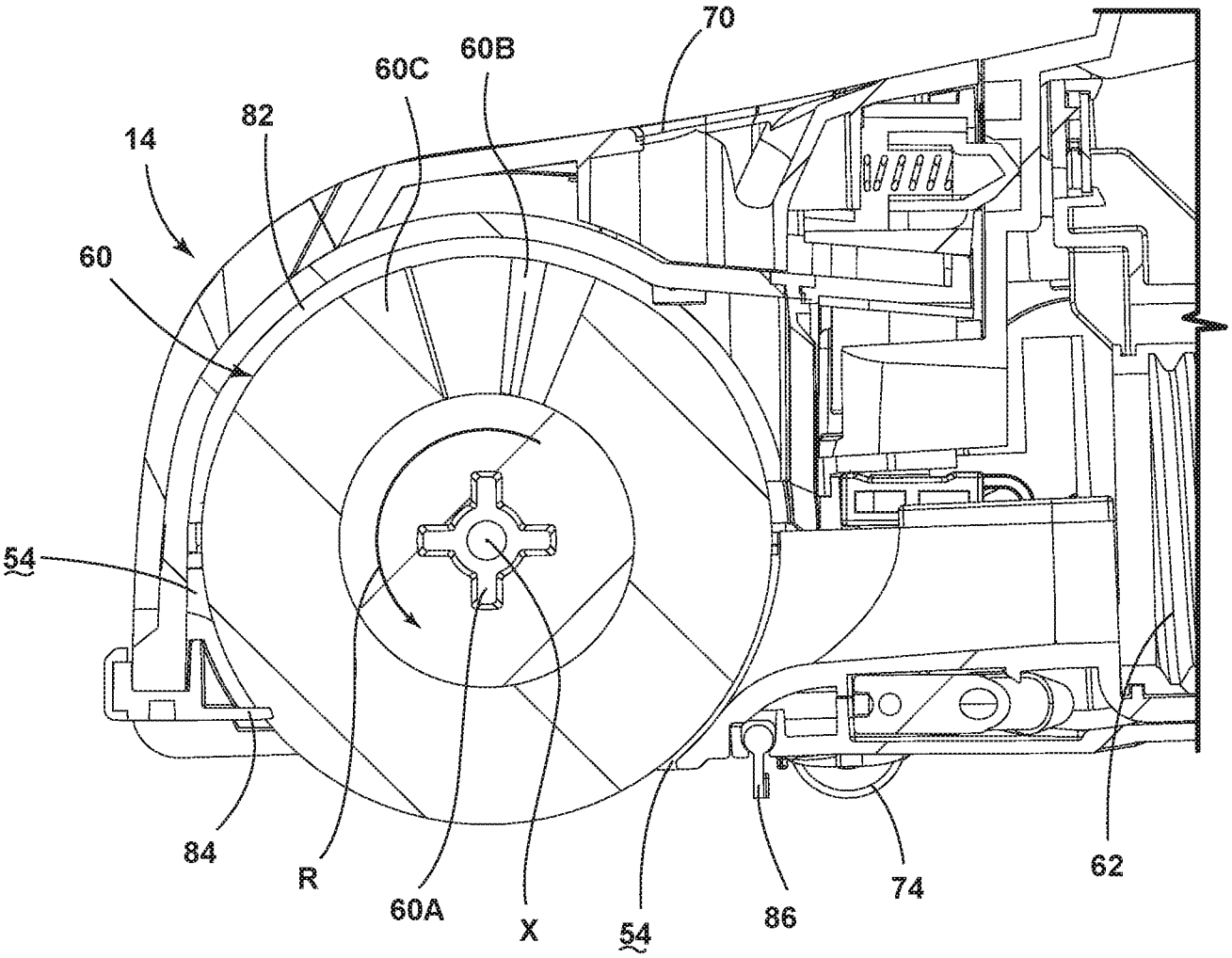
FIG. 5 is an enlarged view of section V of FIG. 3, showing a forward section of the base.

FIG. 5 is an enlarged view of section V of FIG. 3, showing a forward section of the base 14. The brushroll 60 can be provided at a forward portion of the base 14 and received in a brush chamber 82 on the base 14. The brushroll 60 is positioned for rotational movement in a direction R about a central rotational axis X. The brush chamber 82 can be defined at least in part by the suction nozzle 54, or may be defined by another structure of the base 14. In the present embodiment, the suction nozzle 54 is configured to extract fluid and debris from the brushroll 60 and from the surface to be cleaned.

An interference wiper 84 is mounted at a forward portion of the brush chamber 82 and is configured to interface with a leading portion of the brushroll 60, as defined by the direction of rotation R of the brushroll 60, and scrapes excess fluid off the brushroll 60 before reaching the surface to be cleaned. A squeegee 86 is mounted to the base housing 70 behind the brushroll 60 and the brush chamber 82 and is configured to wipe residual fluid from the surface to be cleaned so that it can be drawn into the recovery pathway via the suction nozzle 54, thereby leaving a moisture and streak-free finish on the surface to be cleaned.

In the present example, brushroll 60 can be a hybrid brushroll suitable for use on both hard and soft surfaces, and for wet or dry vacuum cleaning. In one embodiment, the brushroll 60 comprises a dowel 60A, a plurality of bristles 60B extending from the dowel 60A, and microfiber material 60C provided on the dowel 60A and arranged between the bristles 60B. Examples of a suitable hybrid brushroll are disclosed in U.S. Patent Application Publication No. 2018/0110388 to Xia et al, herein by reference in its entirety.

Figure 6:
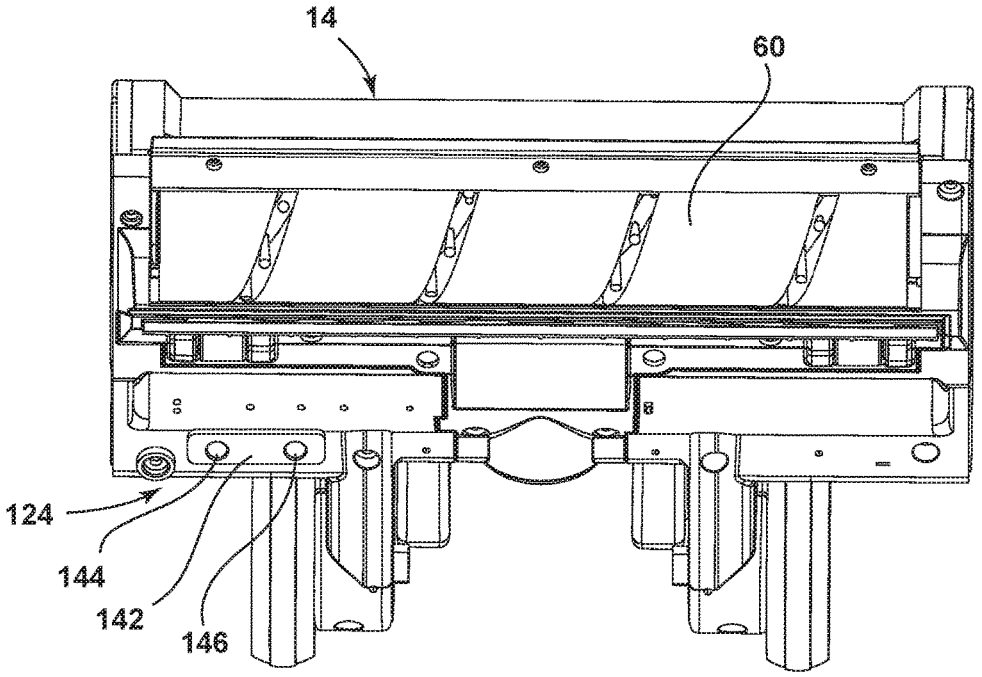
FIG. 6 is a bottom perspective view of the base, showing one embodiment of a floor type sensor.
Figure 7:
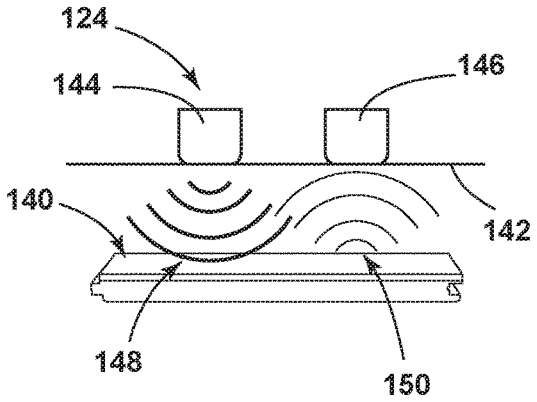
FIG. 7 is a schematic illustration of the floor type sensor of FIG. 6 detecting a wood floor.
Figure 8:
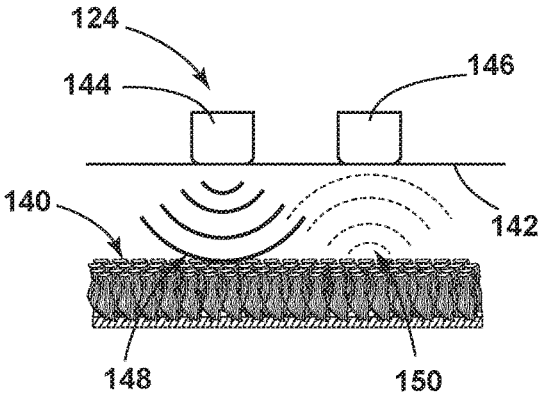
FIG. 8 is a schematic illustration of the floor type sensor of FIG. 6 detecting a carpeted floor.

In FIG. 4, the floor type sensor 124 and soil sensor 136 are schematically shown on the base. The configuration, location, and number of each sensor 124, 136 can vary from the schematic depiction in FIG. 4. FIGS. 6-8 show details of one embodiment of the floor type sensor 124. The floor type sensor 124 shown is an ultrasonic sensor or ultrasonic transducer configured to sense an ultrasonic signal reflected from a floor surface 140 below the base 14. The ultrasonic floor type sensor 124 can be provided on the base 14, such as at a bottom or surface-facing portion 142 of the base 14, optionally to the rear of the brushroll 60. The ultrasonic floor type sensor 124 includes an ultrasonic transmitter 144 and an ultrasonic receiver 146. One or both of the transmitter and receiver 144, 146 can comprise ultrasonic transceivers.

In one method, the ultrasonic transmitter 144 transmits an ultrasonic signal 148 toward the floor surface 140, and the ultrasonic receiver 146 receives reflections 150, which may be stronger or weaker, depending on the floor type. The sensor 124 can generate data that correlates to acoustic energy reflected by the floor surface 140 and send this information to controller 100. The controller 100 uses the sensor data to determine the type of floor surface 140 below the base 14, i.e. being contacted by the base 14. Optionally, the controller 100 can determine whether the type of surface 140 being contacted by the base 14 is carpet, tile, or wood. Other floor types can be detected as well. The connectivity component 104 transmits the floor type to one or more of the remote computing devices 106. The remote computing device 106 identifies an event and/or change in the cycle of operation of the apparatus 10 based on the transmitted floor type. For example, if the data is indicative of the floor surface 140 being wood, as shown in FIG. 7, the remote computing device 106 can identify a wood-cleaning event, and the flow rate and/or brushroll speed can be adjusted as appropriate for cleaning wood. If the data is indicative of the floor surface 140 being carpet, as shown in FIG. 8, the remote computing device 106 can identify a carpet-cleaning event, and the flow rate and/or brushroll speed can be adjusted as appropriate for cleaning carpet.

In one embodiment, the receiver 146 outputs an analog signal to the controller 100, and the controller converts the analog receiver signal to a digital value, normalized between 0 and 1. The lower the digital value, the less reflected signal was received. In general, lower values result from softer floor types (i.e., carpet) and higher values result from harder floor types (i.e., wood, tile, and concrete). Table 1 below lists some non-limiting examples of signal values for different floor types, or other conditions, including open air and a blocked transducer.

TABLE 1

| Floor Type | Signal Value |
|---|---|
| Berber Carpet | 0.62 |
| Concrete | 1.0 |
| Wood | 1.0 |
| Open Air | 0.02 |
| Blocked Transducer | 0.0 |

In some embodiments, the floor type sensor 124 can be used to determine that the base 14 is not contacting a surface, for example, when the base 14 or entire apparatus 10 has been lifted out of contact with a surface. Optionally, the controller 100 can determine whether the base 14 is in contact with open air. For example, Table 1 shows a signal value associated with open air. If the data is indicative of open air, or otherwise indicative of the base 14 being out of contact with a floor surface, the remote computing device 106 can identify an out-of-contact event, and the change in operation of the apparatus 10 can be to power off the vacuum motor 64, pump 78, and/or brush motor 80, or the entire apparatus 10.

Figure 9:
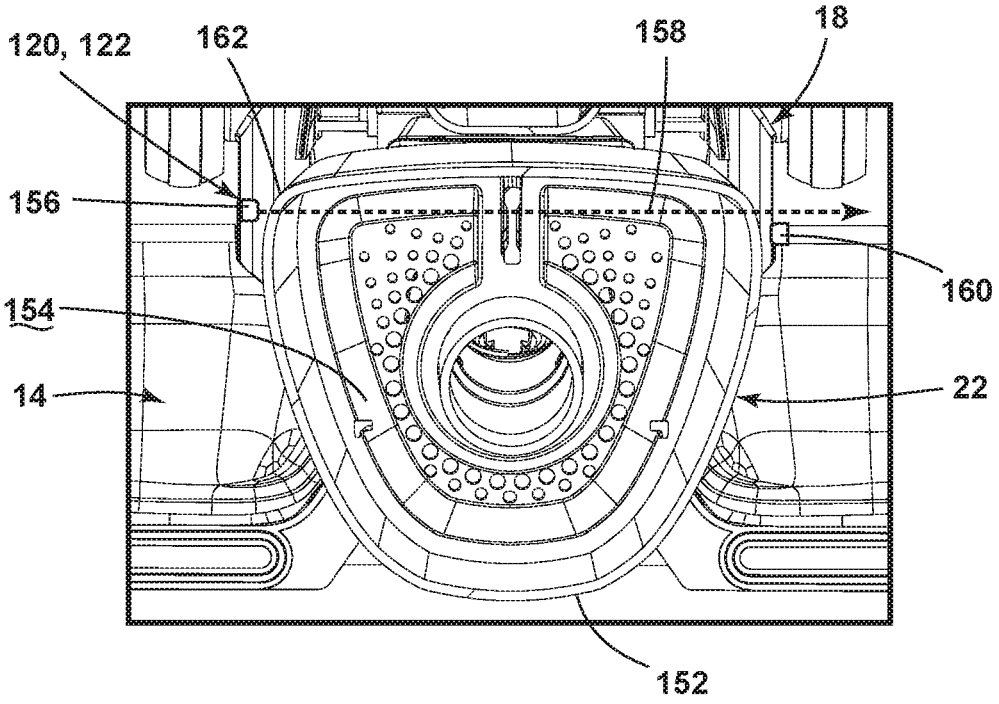
FIG. 9 is a sectional view through a recovery tank for the surface cleaning apparatus of FIG. 2, showing one embodiment of a tank full sensor and schematically illustrating an empty tank condition.
Figure 10:
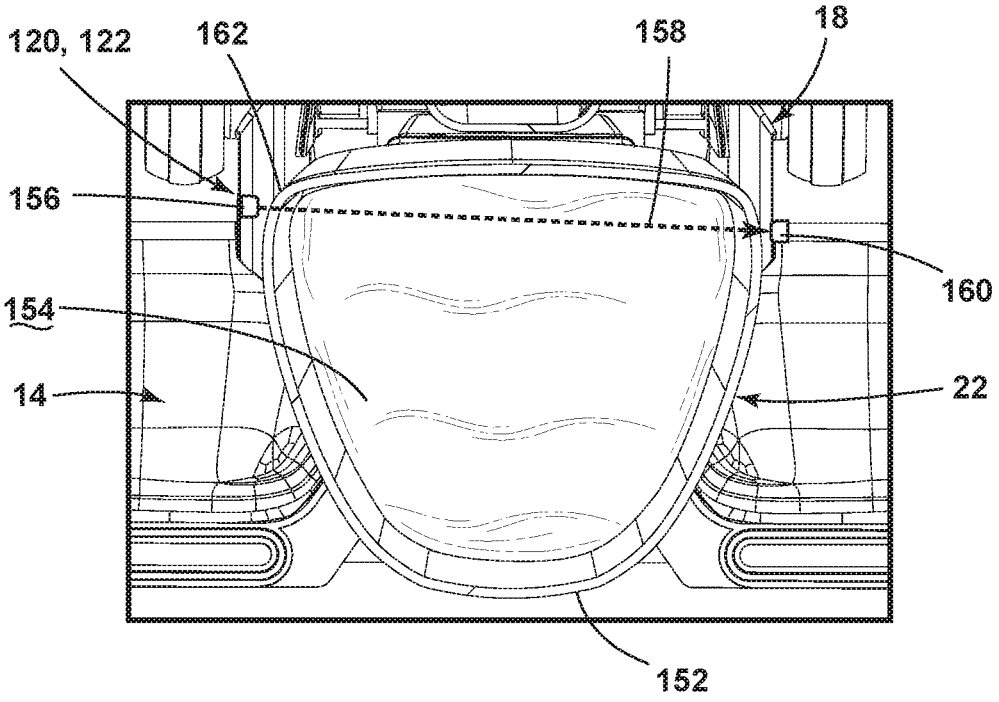
FIG. 10 is a view similar to FIG. 9, schematically illustrating a full tank condition.

FIGS. 9-10 show details of one embodiment of the tank full sensor 120. The tank full sensor 120 shown is an infrared sensor provided adjacent to the recovery tank 22. The infrared tank full sensor 120 is disposed outside the recovery tank 22, such as on the frame 18 (FIG. 3) of the apparatus 10. The recovery tank 22 can include a recovery tank container 152, which forms a collection chamber 154 for the fluid recovery system. When the recovery tank 22 is mounted to the frame 18, fluid communication is established between the base 14 and the recovery tank 22. In addition, when the recovery tank 22 is mounted to the frame 18 as shown, the recovery tank 22 is disposed in opposition to the infrared tank full sensor 120.

The infrared tank full sensor 120 includes an infrared emitter 156 for emitting an infrared beam 158 and an infrared receiver 160 for receiving infrared rays, each disposed outside the recovery tank 22 and configured such that the infrared receiver 160 absorbs the infrared beam 158 emitted by the infrared emitter 156 when liquid is present in the recovery tank 22 and refracts the infrared beam 158, signaling that the tank 22 is full, as shown in FIG. 10. As shown in FIG. 9, when the recovery tank 22 is not full, the infrared beam 158 is not refracted, and the infrared receiver 160 does not absorb the infrared beam 158 emitted by the infrared emitter 156, signaling to the controller 100 (FIGS. 1 and 3) that the tank 22 is not full. Optionally, the infrared emitter and receiver 156, 160 can be positioned at a certain height relative to the tank 22 so that the beam 158 will pass through a level of the recovery tank 22 that corresponds to a full level. Refraction of the beam 158 indicates that liquid is at or above the full level and no refraction of the beam 158 indicates that liquid, if present, is below the full level.

The infrared emitter and receiver 156, 160 can be located on the frame 18 of the apparatus 10, and the infrared beam 158 passes through an outer surface 162 of the recovery tank container 152. FIGS. 9-10 show that the infrared emitter 156 and the infrared receiver 160 can be located on different lateral sides of the recovery tank 22, such that the receiver 160 is positioned to absorb the refracted beam 158 when liquid is present in the recovery tank 22, optionally at a certain height within the recovery tank 22 that corresponds to a full level. In other embodiments, the infrared emitter 156 and the infrared receiver 160 may be arranged in various other angular relationships such that the presence of liquid in the recovery tank 22 changes the intensity of the infrared beam 158 that reaches the infrared receiver 160 by an amount measurable by the infrared receiver 160.

In one method, the infrared emitter 156 emits an infrared beam 158 through the outer surface 162 of the recovery tank container 152, and the intensity of the infrared beam 158 that reaches the infrared receiver 160 is measured. The sensor 120 can send this information to controller 100 (FIGS. 1 and 3). Based on the measured reflection intensity, the controller 100 can determine whether fluid is present within the recovery tank 22 at a predetermined level, i.e. whether the recovery tank 22 is full. The connectivity component 104 transmits this information to one or more of the remote computing devices 106. The remote computing device 106 identifies an event and/or change in the cycle of operation of the apparatus 10 based on whether the recovery tank 22 is full. For example, if the data is indicative of the recovery tank 22 being full, the event identified by the remote computing device 106 can be a volume of fluid in the recovery tank 22 exceeding a predetermined capacity or level within the recovery tank 22. The change in operation of the apparatus 10 can be to power off the apparatus 10 (i.e. turn off the supply of power to the electrical components of the apparatus 10) until the recovery tank 22 has been emptied. The remote device 106 can optionally use the sensor data to determine how many times the recovery tank 22 is emptied during a cleaning event.

Optionally, the infrared sensor also functions as the turbidity sensor 122. In other words, the functions of sensing whether the recovery tank 22 is full and how dirty the liquid collected in the recovery tank 22 is are integrated into one sensor, rather than being performed by separate sensors. In other embodiments, a separate tank full sensor 120 and turbidity sensor 122 are provided. In still other embodiments, a tank full sensor 120 is provided on the apparatus 10 without a turbidity sensor 122. In yet other embodiments, a turbidity sensor 122 is provided on the apparatus without a tank full sensor 120.

In one specific embodiment for sensing turbidity, the infrared emitter 156 can be an infrared light emitting device and the infrared receiver 160 can be a photodiode, and the generated data can include a measurement of the intensity of the absorbed infrared signal. In one method, the infrared emitter 156 emits an infrared beam 158 through the outer surface 162 of the recovery tank container 152, and the intensity of the infrared beam 158 that reaches the infrared receiver 160 is measured. The sensor 120 can send this information to controller 100 (FIGS. 1 and 3). Based on the measured reflection intensity, the controller 100 can determine the turbidity of liquid is present within the recovery tank 22. Turbidity can be estimated based on a ratio of reflection intensity when the recovery tank 22 is filled with clean water vs. various reflection intensities detected at different levels of dirty water. The connectivity component 104 transmits this information to one or more of the remote computing devices 106. The remote computing device 106 identifies an event and/or change in the cycle of operation of the apparatus 10 based on turbidity, i.e. how dirty the collected liquid is. For example, if the data is indicative of the liquid in the recovery tank 22 being very dirty, the event identified by the remote computing device 106 can be a dirty floor event. The change in operation of the apparatus 10 can be increasing the flow rate of cleaning fluid and/or increasing brushroll speed to effectively clean the dirty floor.

In one embodiment, data from the turbidity sensor 122 can be used to dynamically adjust the flow rate and formula mix ratio. For example, instead of one supply tank 20, the apparatus 10 can comprise a clean water tank and a separate tank containing a concentrated chemical formula. Based on the turbidity level of dirty water in the recovery tank 22, the controller 100 can adjust the amount of chemical formula mixed with a given volumetric flow of clean water. If the turbidity is high, then a higher ratio of chemical formula can be used for greater cleaning.

Figure 11:
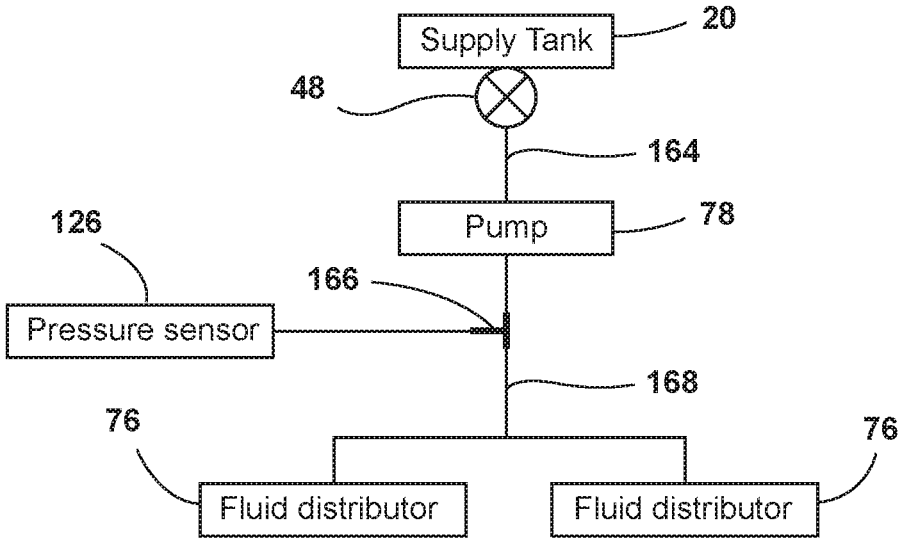
FIG. 11 is a schematic view of a fluid delivery system for the surface cleaning apparatus of FIG. 2, showing one embodiment of a pump pressure sensor.

FIG. 11 shows details of one embodiment of the pump pressure sensor 126. The pump 78 is connected to the supply tank 20, and more particularly to the valve assembly 48, by an inlet tubing 164. The pressure sensor 126 can be coupled to the fluid delivery pathway of the fluid delivery system and can be configured to generate data indicative of an outlet pressure of the pump 78. For example, the pressure sensor 126 can be connected via a T-splice 166 to outlet tubing 168 of the pump 78 where the pressure sensor 126 can generate data that correlates to differential or gauge pressure. In this way, the pressure sensor 126 can generate data that the controller 100 uses to determine an absence of fluid in the supply tank 20. When fluid is present in the supply tank 20 the pump outlet pressure is high, and the pressure sensor 126 can generate data that correlates to a high pump outlet pressure. When the supply tank 20 is empty the pump outlet pressure is low, and the pressure sensor 126 can generate data that correlates to a low pump outlet pressure. Optionally, when the supply tank 20 is nearly empty, i.e. reaches a predetermined low level, the pressure sensor 126 can generate data that correlates to a low pump outlet pressure.

In one method, the pressure sensor 126 can be used to monitor the liquid level of the supply tank 20. The pressure sensor 126 generates data that correlates to pump outlet pressure, and send this information to controller 100. Optionally, the generated data correlates to differential or gauge pressure indicative of an outlet pressure of the pump 78. The connectivity component 104 transmits the pressure sensor data to one or more of the remote computing devices 106. The event identified by the remote computing device 106 can be an absence of fluid in the supply tank 20 or an empty supply tank event. The change in operation of the apparatus 10 can be to power off the apparatus 10 (i.e. turn off the supply of power to the electrical components of the apparatus 10) until the supply tank 20 has been refilled in order to avoid mistakenly cleaning an area without any cleaning fluid. The remote device 106 can optionally use the sensor data to determine how many times the supply tank 20 is refilled during a cleaning event.

Figure 12:
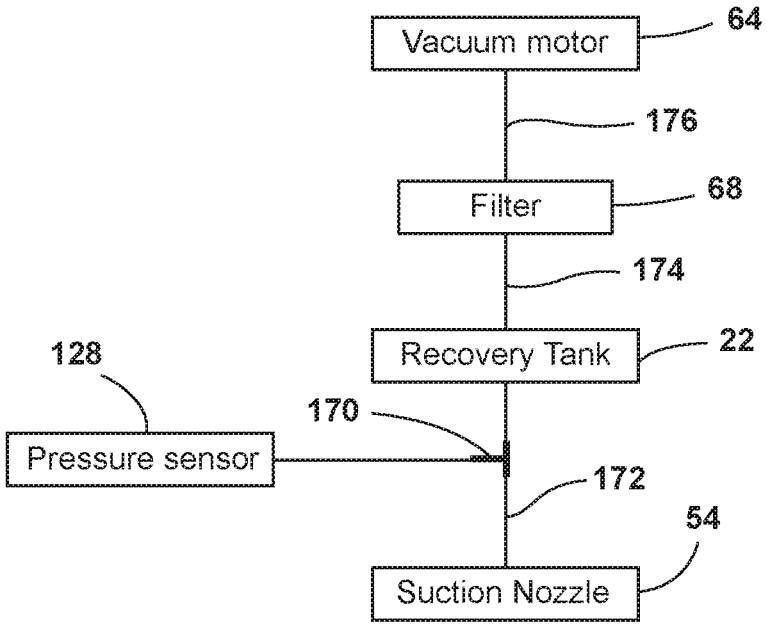
FIG. 12 is a schematic view of a recovery system for the surface cleaning apparatus of FIG. 2, showing one embodiment of a recovery system or filter status sensor.

FIG. 12 shows details of one embodiment of the recovery system or filter status sensor 128. The filter status sensor 128 shown is a pressure transducer configured to sense pressure in the recovery pathway of the apparatus 10. The filter status sensor 128 can be coupled to the recovery pathway of the recovery system, and can be configured to generate data indicative of pressure in the recovery pathway. For example, the filter status sensor 128 can be connected via a T-splice 170 to tubing 172 fluidly coupling the suction nozzle 54 to the recovery tank 22. In this location, the sensor 128 can detect pressure changes due to changing conditions at the recovery tank 22, filter 68, or the vacuum motor 64. In other embodiments, the filter status sensor 128 can be coupled to a portion of the air pathway 174 between the air outlet of the recovery tank 22 and the filter 68, or a portion of the air pathway 176 between the filter 68 and the vacuum motor 64.

In one method, the filter status sensor 128 can monitor pressure in the recovery pathway of the apparatus 10. The filter status sensor 128, which can be a pressure transducer, generates data that correlates to pressure in the recovery pathway, and sends this information to controller 100. The connectivity component 104 transmits the filter status sensor data to one or more of the remote computing devices 106. The event identified by the remote computing device 106 can be an operational status of the vacuum motor 64 (i.e. whether the vacuum motor 64 is "on" or "off"), the presence of the air filter 68, the presence of the recovery tank 22, and an air flow rate through the air filter 68. Optionally, the airflow rate through the filter 68 can be identified in terms of whether the filter 68 is "clean" or "clogged". As another option, the airflow rate through the filter 68 can be identified as a percentage of blockage of airflow through the filter 68. The change in operation of the apparatus 10 can be to power off the apparatus 10 (i.e. turn off the supply of power to the electrical components of the apparatus 10) until the filter 68 is cleaned or replaced, or the recovery tank 22 has been replaced. The user may be notified of the event via the user interface 32 or via an application configured on a portable electronic device, such as by illuminating a light indicating that the filter 658 is missing or clogged or displaying a blockage percentage for the filter 68.

In one embodiment, the filter status sensor 128 outputs an analog voltage signal to the controller 100 that is proportional to pressure in the recovery pathway. The controller converts the analog voltage signal to a digital value, normalized between 0 and 1. The lower the digital value, the lower the pressure in the recovery pathway. In general, lower values (e.g., <0.1) result from the filter 68 or the recovery tank 22 being missing from the recovery pathway, i.e. being removed from the apparatus 10. Mid-range values (e.g., 0.1–0.5) result from different levels of filter clogging. Higher values (e.g., >0.5) result from a high level filter clogs (e.g. the filter 68 being greater than 75% blocked) or an air outlet of the recovery tank 22 being closed, for example when a shut-off float in the recovery tank 22 closes the air outlet, which occurs when the recovery tank 22 is full. Table 2 below lists some non-limiting examples of signal values for different pressure conditions in the recovery pathway.

TABLE 2

| Condition | Signal Value |
|---|---|
| Vacuum motor off | 0.0 |
| Vacuum motor on; no recovery tank | 0.01364 |

TABLE 2-continued

| Condition | Signal Value |
|---|---|
| Vacuum motor on; no filter | 0.04091 |
| Vacuum motor on; clean filter | 0.26212 |
| Vacuum motor on; filter 25% blocked | 0.29545 |
| Vacuum motor on; filter 50% blocked | 0.34697 |
| Vacuum motor on; filter 75% blocked | 0.46212 |
| Vacuum motor on; filter 100% blocked | 0.99848 |
| Vacuum motor on; tank outlet closed | 1.0 |

Figure 13:
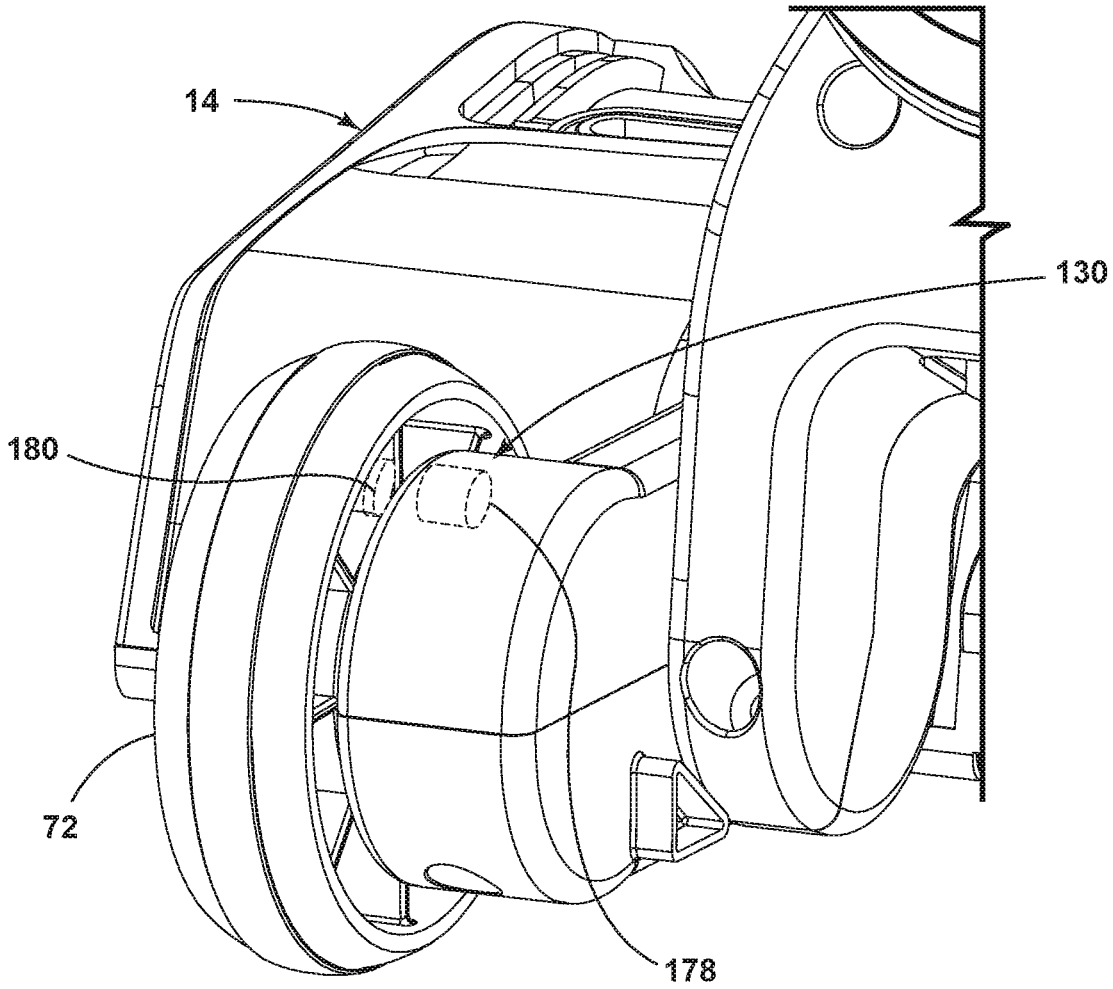
FIG. 13 is a rear perspective view of a portion of the base, showing one embodiment of a wheel rotation sensor.

FIG. 13 shows details of one embodiment of the wheel rotation sensor 130. The wheel rotation sensor 130 is configured to sense the rotation of one of the wheels 72, 74 (FIG. 3), and can generate data that correlates to the number of revolutions of the wheel. In FIG. 13, the wheel is shown as one of the rear wheels 72, although it is understood that the configuration, location, and number of the sensor 130 can vary from the schematic depiction in FIG. 13, and that any of the wheels 72, 74 of the apparatus 10 may include a wheel rotation sensor 130.

The wheel rotation sensor 130 shown is a Hall Effect sensor 178, and the wheel 72 includes a magnet 180. The Hall Effect sensor 178 can be mounted to a portion of the base 14 which is disposed adjacent to the wheel 72 and which remains stationary as the wheel 72 rotates. The magnet 180 in the wheel 72 creates a pulse signal in the Hall Effect sensor 178. Counted pulses and the circumference of the wheel 72 are used to determine a distance traveled during cleaning.

In one method, the wheel rotation sensor 130 can monitor the rotation of the wheel 72. The wheel rotation sensor 130 generates data related to rotation of the wheel 72, and sends this information to the controller 100 (FIGS. 1 and 3). Optionally, the sensor 130 can generate data that correlates to the number of revolutions of the wheel 72, and provide this information to the controller 100. The controller 100 receives the output signals from the wheel rotation sensor 130, and uses this information to determine a distance traveled during cleaning. The determined distance may be an actual distance or an estimated distance. The connectivity component 104 transmits the distance traveled to one or more of the remote computing devices 106. The event identified by the remote computing device 106 can be a determination of a distance cleaned, an area cleaned, and/or a rotations per minute for the wheel 72. These events can used as an additional input for determining when preventative maintenance is needed or for warranty purposes. The change in operation of the apparatus 10 can be providing a notification to the user that preventative maintenance is required, such as displaying the notification on the user interface 32, and/or powering off the apparatus 10 (i.e. turn off the supply of power to the electrical components of the apparatus 10) until preventative maintenance has been performed. The remote device 106 can use the usage data to determine when to send notifications through the mobile application (e.g., a notification to buy more formula, a notification to clean the filter, a notification to replace the brushroll, etc.)

In one embodiment, the width of the cleaning path (W) and average stroke overlap (O) can be used to convert the estimated distance (D) to an area cleaned (A) using the following equation:

$$A=D\times W\times O$$

For example, if the average cleaning stroke overlaps another cleaning stroke by 25%, the value for O can be 0.25.

Figure 14:
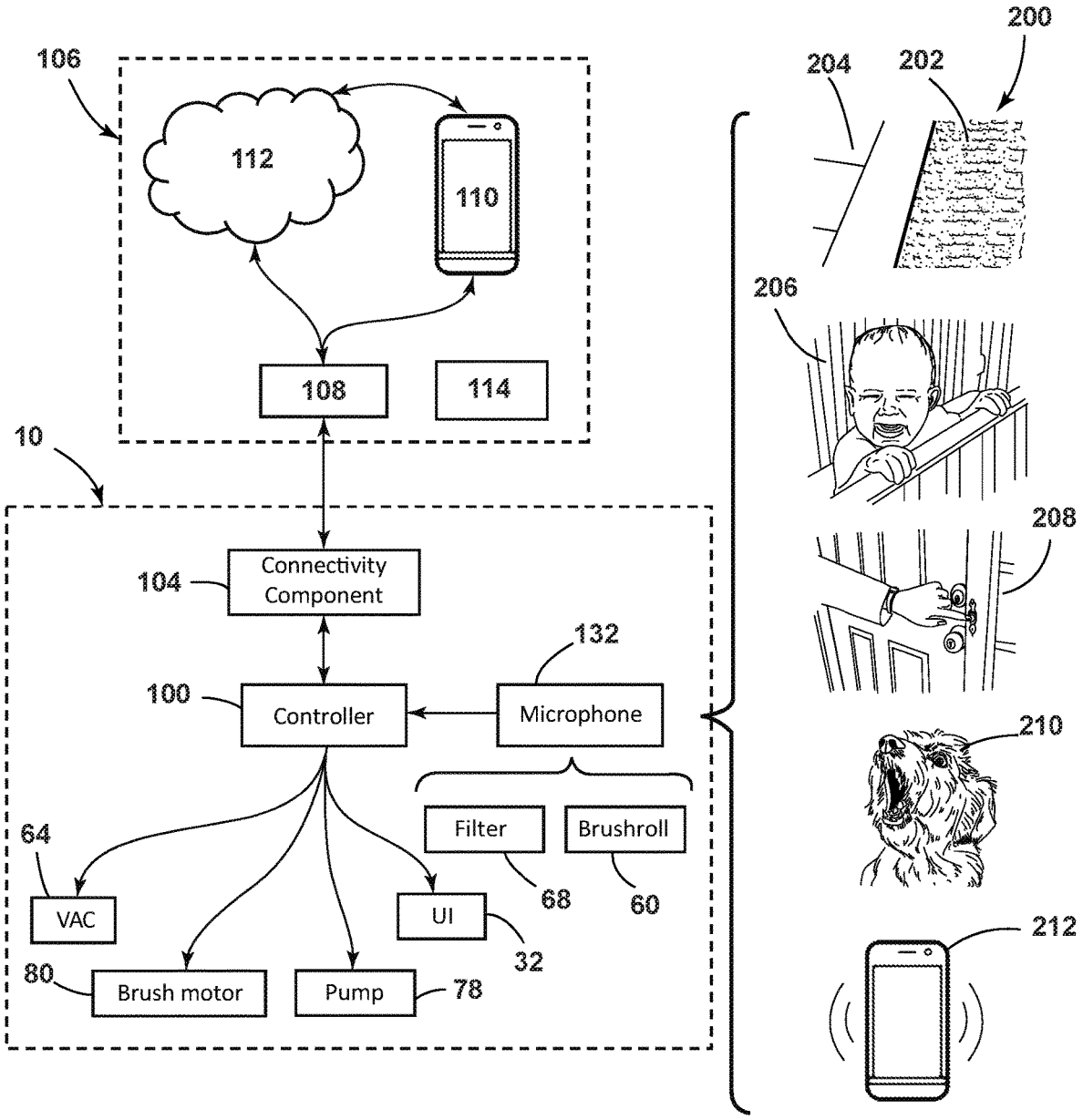
FIG. 14 is a schematic illustration of the system of FIG. 1, showing one embodiment of a microphone for detecting audible noise generated by the apparatus or the surrounding environment.

FIG. 14 shows one embodiment of the system using the acoustic sensor 132 to detect audible noise generated by the apparatus or the surrounding environment. The acoustic sensor 132 shown is a microphone. The microphone 132 can be provided on the upright body 12 of the apparatus 10 (FIG. 2) or in another location on the apparatus 10.

In one method, the microphone 132 records audible noise. The microphone 132 can generate data that correlates to audible noise generated by the apparatus 10 and/or the surrounding environment 200, and provides this information to the controller 100. The controller 100 and/or the remote device 106 analyses the data by recognizing patterns in the acoustic vibrations that correlates to different conditions, such as a clogged filter 68, a missing filter 68, a broken belt (i.e. for a belt coupling the brushroll 60 and the brush motor 80), or a non-rotating or jammed brushroll 60, and/or to discern information about the surrounding environment 200, such as a type of surface being contacted by the base 14 (i.e. carpet 202 or wood 204) or background events such as a baby's cry 206, a ringing doorbell 208, a barking pet 210, or a ringing phone 212. The connectivity component 104 transmits the audible noise data to one or more of the remote computing devices 106. The remote computing device 106 identifies an event or change in the cycle of operation of the apparatus 10 based on the transmitted audible noise data. For example, if the data is indicative of the floor surface 140 being wood, the remote computing device 106 can identify a wood-cleaning event, and the flow rate and/or brushroll speed can be adjusted as appropriate for cleaning wood. In the event of a baby's cry, the change in operation of the apparatus 10 can be to power off the apparatus 10 so that the sound of the baby is not obstructed by the operational noise of the apparatus 10.

Figure 15:
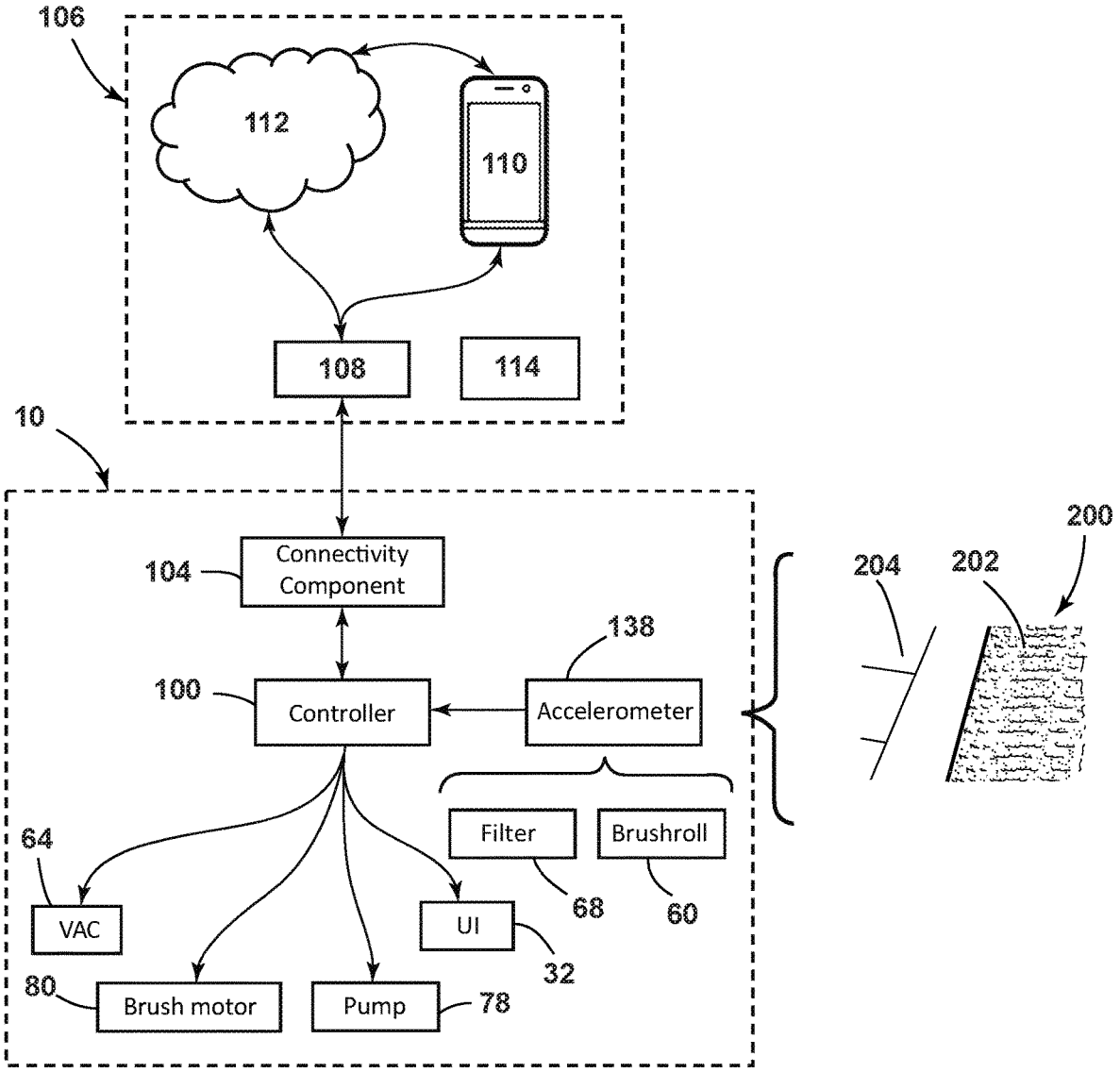
FIG. 15 is a schematic illustration of the system of FIG. 1, showing one embodiment of an accelerometer for detecting vibrations generated by the apparatus or the surrounding environment.

FIG. 15 is a schematic illustration of the system of FIG. 1, showing one embodiment of the accelerometer 138. The accelerometer can be used in addition to, or as an alternative to, the acoustic sensor 132 to detect information about the apparatus 10 and/or the surrounding environment 200. Instead of recording audible noise, the accelerometer 138 measures vibrations generated by the apparatus 10 or the surrounding environment 200. The accelerometer 138 can be provided on the upright body 12 of the apparatus 10 (FIG. 2) or in another location on the apparatus 10.

In one method, the accelerometer 138 measures vibration. The accelerometer 138 can generate data that correlates to vibrations generated by the apparatus 10 and/or the surrounding environment 200, and provides this information to the controller 100. The controller 100 and/or the remote device 106 analyses the data by recognizing patterns in the acoustic vibrations that correlates to different conditions, such as a clogged filter 68, a missing filter 68, a broken belt (i.e. for a belt coupling the brushroll 60 and the brush motor 80), a non-rotating or jammed brushroll 60, and/or to discern information about the surrounding environment 200, such as a type of surface being contacted by the base 14 (i.e. carpet 202 or wood 204), or any combination thereof. The connectivity component 104 transmits the vibration data to one or more of the remote computing devices 106. The remote computing device 106 identifies an event or change in the cycle of operation of the apparatus 10 based on the transmitted vibration data. For example, if the data is indicative of a jammed brushroll, the change in operation of the apparatus 10 can be to power off at least the brush motor 80, or the entire apparatus 10. A notification to the user that brushroll maintenance is required, such as displaying the notification on the user interface 32.

Table 3 below lists some non-limiting examples events and resulting changes at the apparatus 10 and the remote device 106. The events lists can be determined based on data from the microphone 132 and/or from the accelerometer 138.

TABLE 3

| Event | Apparatus Change | Remote Device Change |
|---|---|---|
| Floor Type - Carpet | Turn on brushroll<br>Increase brushroll speed<br>Raise nozzle height<br>Increase suction<br>Increase flow rate | Display notification |
| Floor Type - Wood | Turn off brushroll<br>Reduce brushroll speed<br>Lower nozzle height<br>Reduce flow rate | Display notification |
| Clogged Filter | Turn off brush motor<br>User notification | Display notification<br>Display instructions for removing, cleaning, and/or replacing filter<br>Display link to buy new filter |
| Missing Filter | Turn off brush motor<br>User notification | Display notification<br>Display link to buy new filter |
| Broken Belt | Turn off brush motor<br>User notification | Display notification<br>Display link to buy new belt<br>Display instructions for replacing belt |
| Jammed Brushroll | Turn off brush motor<br>User notification | Display notification<br>Display instructions for cleanout |
| Baby Cry | Turn off apparatus<br>User notification | Display notification |
| Doorbell | Turn off apparatus<br>User notification | Display notification |
| Barking Pet | Turn off apparatus<br>User notification | Display notification |
| Phone Call | Turn off apparatus<br>User notification | Display notification |

Using the methods of FIGS. 14-15, the system can passively detect and recognize multiple events at the apparatus 10 or in the surrounding environment. Additionally, implementing the system using a microphone 132 or an accelerometer 138 on the apparatus 10 is relatively low cost and small in size, as well as being low in power consumption and highly reliable.

Figure 16:
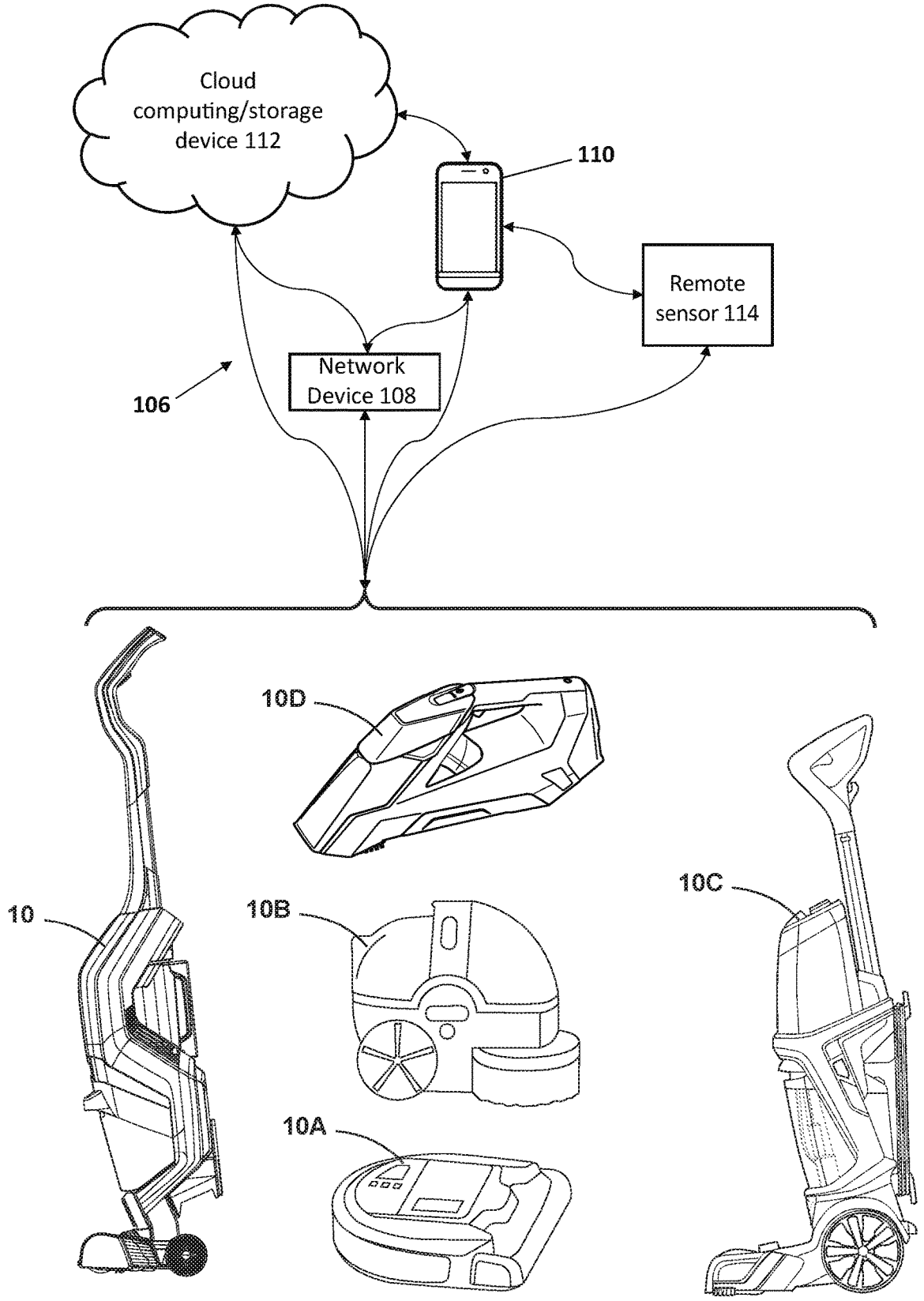
FIG. 16 is a schematic view of a system including multiple connected surface cleaning apparatuses, according to another embodiment of the invention.

Although the figures have thus far shown aspects and embodiments of the invention in the context of a cleaning apparatus comprising an upright device, it is recognized that numerous variations are possible whereby the controller 100, one or more sensors 102, and connectivity component 104 can be configured for incorporation into virtually any type of floor cleaning apparatus. According to the invention, the floor cleaning apparatus can be any apparatus capable of cleaning, treating or disinfecting a surface to be cleaned. The floor cleaning apparatus can include, but is not limited to any of the following: a multi-surface vacuum cleaner, an autonomous floor cleaner, an unattended spot-cleaning apparatus or deep cleaner, an upright deep cleaner or extractor, a handheld extractor, a vacuum cleaner, a sweeper, a mop, a steamer, an ultraviolet radiation disinfecting device, a treatment dispensing device, and combinations thereof. FIG. 16 shows one embodiment where the system can be used with multiple surface cleaning apparatus, including at least a multi-surface vacuum cleaner 10, an autonomous floor cleaner 10A, an unattended spot-cleaning apparatus or deep cleaner 10B, an upright deep cleaner or extractor 10C, or a handheld extractor 10D. Non-limiting examples of these floor cleaners 10-10D include a multi-surface vacuum cleaner as disclosed in U.S. Pat. No. 10,092,155 to Xia et al., an autonomous or robotic vacuum cleaner as disclosed in U.S. Patent Application Publication No. 2018/0078106 to Scholten et al., an unattended extraction cleaner disclosed in U.S. Pat. No. 7,228,589 to Miner et al., a portable extraction cleaner disclosed in U.S. Pat. No. 9,474,424 to Moyher Jr. et al., an upright extraction cleaner disclosed in U.S. Pat. No. 6,131,237 to Kasper et al., and a handheld extractor disclosed in U.S. Patent Application Publication No. 2018/0116476 to Bloemendaal et al., all of which are incorporated herein by reference in their entirety.

Figure 17:
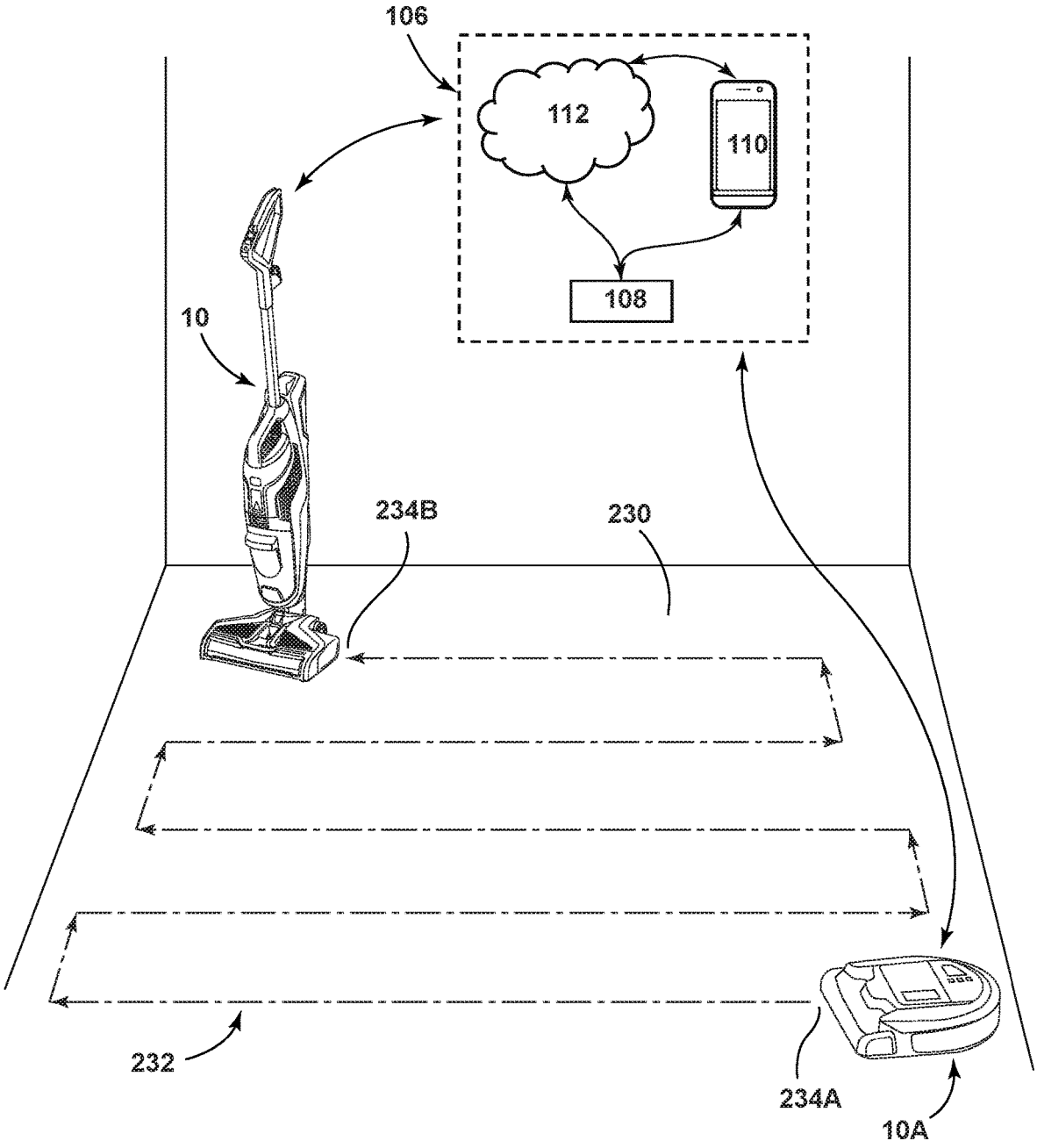
FIG. 17 is a schematic illustration of a system including multiple connected surface cleaning apparatuses, according to another embodiment of the invention, the system including at least one manual surface cleaning apparatus and at least one autonomous surface cleaning apparatus.
Figure 18:
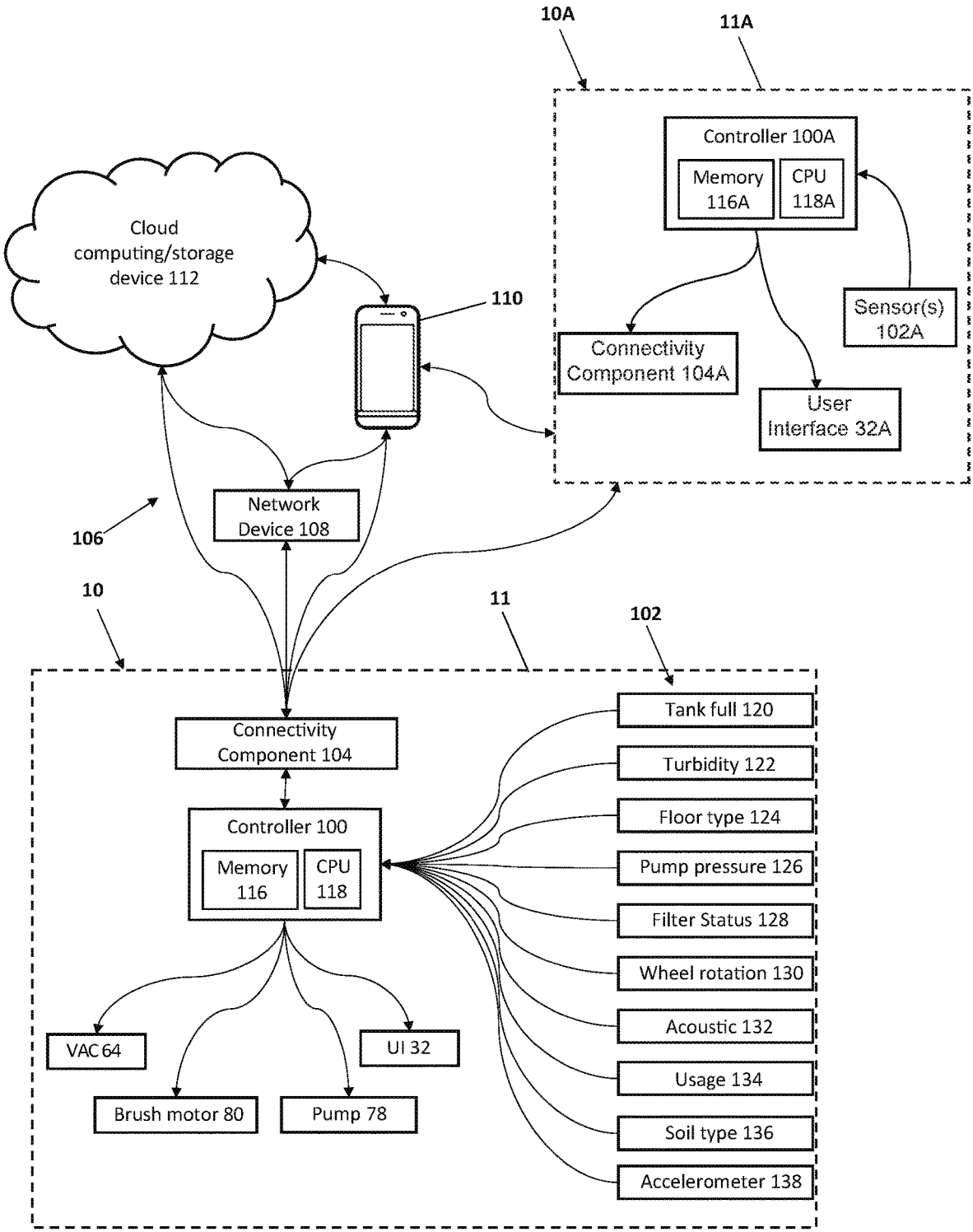
FIG. 18 is a schematic view of the system of FIG. 17.

FIGS. 17-18 show an embodiment where the system can be used with multiple surface cleaning apparatus, including at least one attended or user-operated floor cleaner 10 and at least one unattended, autonomous floor cleaner or robot 10A. The floor cleaners 10, 10A are configured to share information, such as mapping and/or navigation information. The system can use a mimic protocol, with the manual floor cleaner 10 recording a cleaning path and the robot 10A subsequently performing the recorded cleaning path. In one embodiment, the remote computing device 106 is configured to store a cleaning path followed by the manual floor cleaner 10, and transfer the cleaning path to the robot 10A. During a subsequent cycle of operation, the robot 10A traverses the cleaning path. Using the recorded cleaning path can be an improvement over relying on the autonomous navigation/mapping system of the robot 10A, as the recorded cleaning path can ensure complete cleaning of a room while limiting doubling back on previously cleaned areas. This can also conserve battery life of the robot 10A.

In one embodiment, the remote computing device 106 is configured to store a cleaning path of the manual floor cleaner 10 based on the distance cleaned, the area cleaned, and/or the rotations per minute of the wheel 74. Such information can, for example, be determined based on the wheel rotation sensor 130, described previously. The remote computing device 106 can transfer the cleaning path to the robot 10A, and the robot 10A can traverse the cleaning path during a subsequent cycle of operation.

Referring to FIG. 18, the first or manual floor cleaner 10 can comprise the components discussed above with respect to FIGS. 1-15, including the controller 100, one or more sensors 102, and the connectivity component 104. The controller 100 is configured to collect data provided by the one or more sensors 102 which correlates to a cleaning path traveled by the manual floor cleaner, and the connectivity component 104 is configured to transmit the data to one or more remote computing devices 106, such as the network device 108, mobile device 110, and/or cloud computing/storage device 112.

The second or autonomous floor cleaner 10A can comprise at least some of the same components as the manual floor cleaner 10, including at least user interface 32A, a controller 100A having a memory 116A and processor 118A, one or more sensors 102A, and a connectivity component 104A. The controller 100A is configured to receive data provided by the remote computing device 106, which correlates to a cleaning path traveled by the manual floor cleaner 10. The robot 10A can have additional systems and components in an autonomously moveable unit or housing, including components of a vacuum collection system for generating a working air flow for removing dirt (including dust, hair, and other debris) from the surface to be cleaned and storing the dirt in a collection space on the robot 10A, a drive system for autonomously moving the robot 10A over the surface to be cleaned, a navigation system for guiding the movement of the vacuum cleaner over the surface to be cleaned, a mapping system for generating and storing maps of the surface to be cleaned and recording status or other environmental variable information, and/or a dispensing system for applying a treating agent stored on the robot 10A to the surface to be cleaned. Examples of an autonomous or robotic vacuum cleaner are disclosed in U.S. Patent Application Publication No. 2018/0078106 to Scholten et al., and U.S. Pat. No. 7,320,149 to Huffman et al., both of which are incorporated herein by reference in their entirety.

Wheel rotation sensors 130, which may be shaft encoders in the wheels 72, of the manual vacuum cleaner 10 measure the distance travelled. Multiple shaft encoders can be used, including one on each wheel 72. This measurement can be provided as input to the controller 100, which can translate angular position data into a recorded cleaning path of the manual vacuum cleaner 10. The manual cleaning path is transcribed into instructions for a cleaning path to be followed by the robot 10A. The transcription can be performed by the controller 100, the remote device 106, or a docking station for the robot 10A (i.e. docking station 240, FIG. 19). The transcribed cleaning path for the robot 10A can include a series of navigation instructions, or directions, to guide the movement of the robot 10A along the same cleaning path, or a substantially duplicate cleaning path, as the cleaning path recorded by the manual vacuum cleaner 10. For example, the transcribed cleaning path for the robot 10A can include instructions for forward movement, rearward movement, left and right turns, number of wheel revolutions, turn degrees, and stops (i.e. forward for 10 wheel revolutions, left turn 90 degrees, forward for 8 wheel revolutions, left turn 30 degrees, etc.). Table 4 below lists is a non-limiting example of how angular data collected from the wheel rotation sensors 130 of the manual vacuum cleaner 10 may be transcribed into distance instructions for a cleaning path to be followed by the robot 10A.

TABLE 4

| MANUAL VACUUM CLEANER | | | | ROBOT | |
|---|---|---|---|---|---|
| Left Wheel Angle | Right Wheel Angle | Left Wheel Distance (mm) | Right Wheel Distance (mm) | Left Wheel Distance (mm) | Right Wheel Distance (mm) |
| 0° | 0° | 0 | 0 | 0 | 0 |
| 84° | 109° | 37 | 48 | 24 | 31 |
| 185° | 184° | 81 | 80 | 52 | 52 |
| 321° | 317° | 140 | 138 | 91 | 90 |
| 414° | 409° | 181 | 178 | 117 | 116 |
| 563° | 512° | 246 | 223 | 160 | 145 |
| . . . | . . . | . . . | . . . | . . . | . . . |

FIG. 17 depicts one method of using the system. The method can begin with the operation of the manual vacuum cleaner 10 to vacuum clean a floor surface 230. For example, the vacuum cleaner 10 may traverse and record a cleaning path 232 on the floor surface 230, beginning at position 234A and ending at position 234B. Optionally, the recorded cleaning path 232 can comprise sensor data that correlates to the cleaning path 232, such as data from the wheel rotation sensor 130 (FIG. 18) that relates to the rotation of one or more of the wheels.

The recorded cleaning path 232, optionally in the form of sensor data, is transferred from the manual vacuum cleaner 10 to the remote device 106. Optionally, when provided with sensor data correlated to the cleaning path 232, the remote computing device 106 can determine a distance cleaned, an area cleaned, and/or RPMs sensed by the wheel sensor 130.

The recorded cleaning path 232 can be transcribed into instructions for a cleaning path to be followed by the robot 10A. The transcription can be performed by the controller 100, the remote device 106, or a docking station for the robot 10A (i.e. docking station 240, FIG. 19).

The remote device 106 transfers the cleaning path to the robot 10A. Subsequently, the robot 10A traverses the same cleaning path 232 on the floor surface 230, beginning at position 234A and ending at position 234B. In other embodiments, the robot 10A may traverse a path this is based on the first path 232, but differs in starting position, ending positions, and/or one or more waypoints along the path 232.

Figure 19:
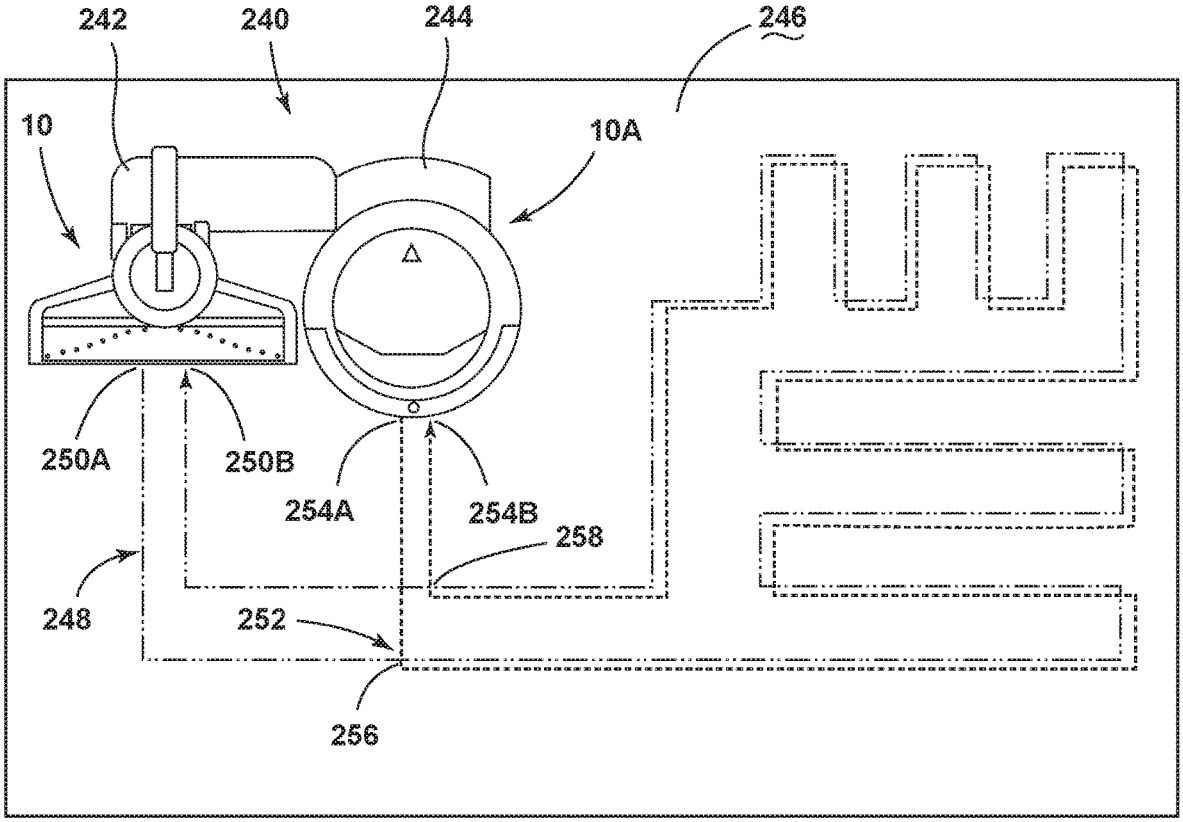
FIG. 19 is a schematic view showing a common docking station for the multiple connected surface cleaning apparatuses of FIG. 17.

As shown in FIG. 19, in some embodiments, the floor cleaners 10, 10A can share a common docking station 240 for recharging the cleaners or servicing the cleaners in other ways. In one example, the docking station 240 can be connected to a household power supply, such as an A/C power outlet, and can include a converter for converting the AC voltage into DC voltage for recharging the power supply on-board each floor cleaner 10, 10A. The docking station 240 has a first dock 242 for charging the manual floor cleaner 10 and a second dock 244 for charging the robot 10A. Each dock 242 can be provided with charging contacts compatible with corresponding charging contacts on the floor cleaner 10, 10A. The docking station 240 can also include various sensors and emitters (not shown) for monitoring cleaner status, enabling auto-docking functionality, communicating with each floor cleaner 10, 10A, as well as features for network and/or Bluetooth connectivity.

The vacuum cleaner 10 and robot 10A can be docked together at the docking station 240 to facilitate common charging and communication between the devices. The batteries of the vacuum cleaner 10 and robot 10A can be recharged at the same time, or one at a time to conserve power. The vacuum cleaner 10 and robot 10A can communicate via a wired connection when docked at the docking station 240. Alternatively, the vacuum cleaner 10 and robot 10A can communicate wirelessly, whether docked or not docked.

In one embodiment, one or more remote computing devices 106 (FIG. 18) can be integrated with docking station 240. The vacuum cleaner 10 and robot 10A can transmit data to the docking station 240 when docked or when separated from the docking station 240.

FIG. 19 also depicts a method of using the system and common docking station 240. The method can begin with the operation of the manual vacuum cleaner 10 to vacuum clean a floor surface 246. For example, the vacuum cleaner 10 may traverse a first path 248 on the floor surface 246, beginning at position 250A and ending at position 250B. As shown herein, both the beginning and ending positions are at the docking station 240, optionally at the first dock 242, but in other embodiments the beginning and ending positions 250A, 250B can be elsewhere, including having different beginning and ending positions. Optionally, the recorded cleaning path 248 can comprise sensor data that correlates to the cleaning path 248, such as data from the wheel rotation sensor 130 (FIG. 18) that relates to the rotation of one or more of the wheels.

The recorded cleaning path 248, optionally in the form of sensor data, is transferred from the manual vacuum cleaner 10 to the remote device 106 (FIG. 18). Optionally, when provided with sensor data correlated to the cleaning path 248, the remote computing device 106 can determine a distance cleaned, an area cleaned, and/or RPMs sensed by the wheel sensor 130.

The recorded cleaning path 248 can be transcribed into instructions for a cleaning path 252 to be followed by the robot 10A. The transcription can be performed by the controller 100, the remote device 106, or the docking station 240.

The remote device 106 transfers the cleaning path 252 to the robot 10A. Subsequently, the robot 10A traverses the transferred path 252 on the floor surface 246, beginning at position 254A and ending at position 254B. As shown herein, both the beginning and ending positions 254A, 254B are at the docking station 240, optionally at the second dock 244, but in other embodiments the beginning and ending positions 254A, 254B can be elsewhere, including having different beginning and ending positions. As shown, the transferred path 252 traveled by the robot 10A may not be identical to the manual path 248 recorded by the manual vacuum cleaner 10. Rather, the transferred path 252 can be calculated to drive the robot 10 to a point 256 in the cleaning path closest to the docking station 240, which can conserve battery life. Similarly, the transferred path 252 can diverge from the manual cleaning path 248 at a point 258 where the robot 10 returns to the docking station 240. In other embodiments, the transferred path 252 may differ from the recorded path 248 at one or more waypoints along the recorded path 248.

Figure 20:
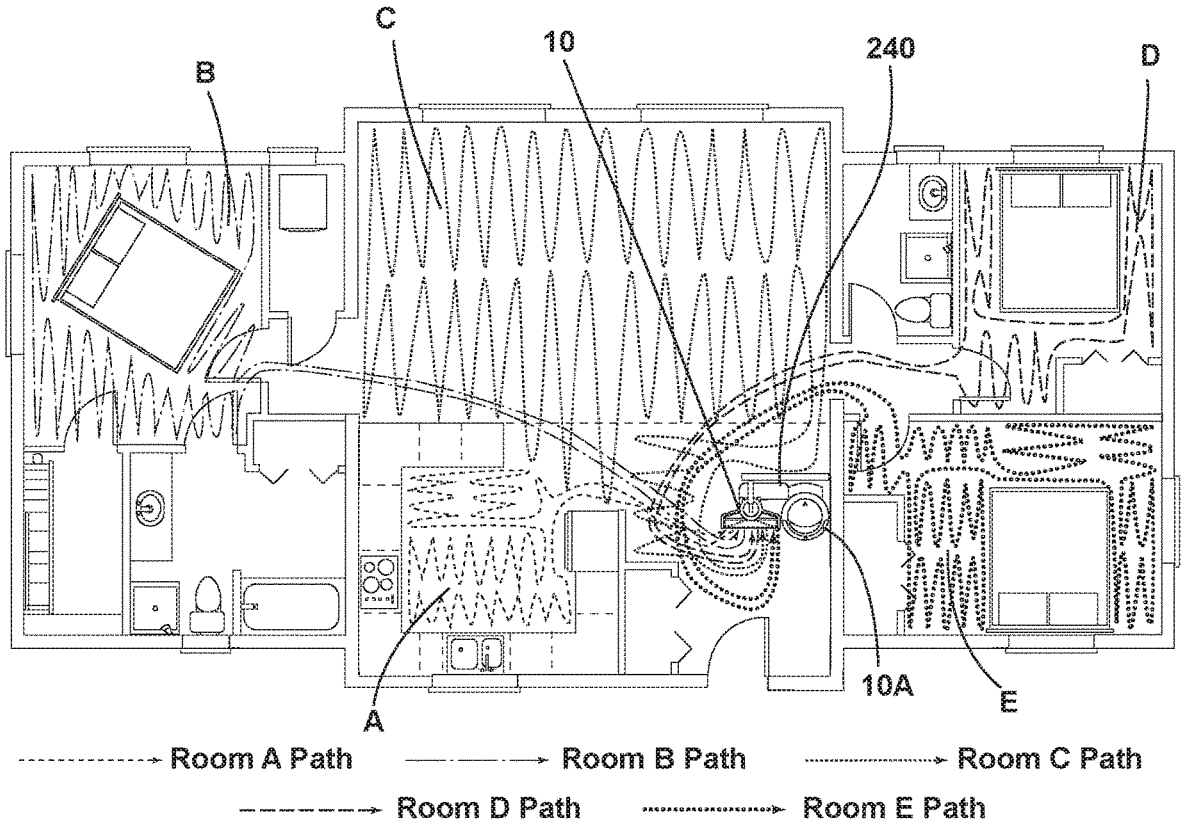
FIG. 20 is a schematic view depicting a method of operation using the common docking station of FIG. 19.

As shown in FIG. 20, in some embodiments, the manual vacuum cleaner 10 can record and store multiple cleaning paths. Each cleaning path may be recorded under a unique path identifier. As shown herein, the unique path identifier may be Room A, Room B, Room C, Room D, Room E, and so on, although it is understood that a recorded cleaning path may actually correspond to cleaning less than a full room, cleaning more than one room, or other units of area. The beginning and ending positions of the cleaning paths A-E are shown as being at the docking station 240. Other recorded cleaning paths can have beginning and ending positions elsewhere, including having different beginning and ending positions.

Figure 21:
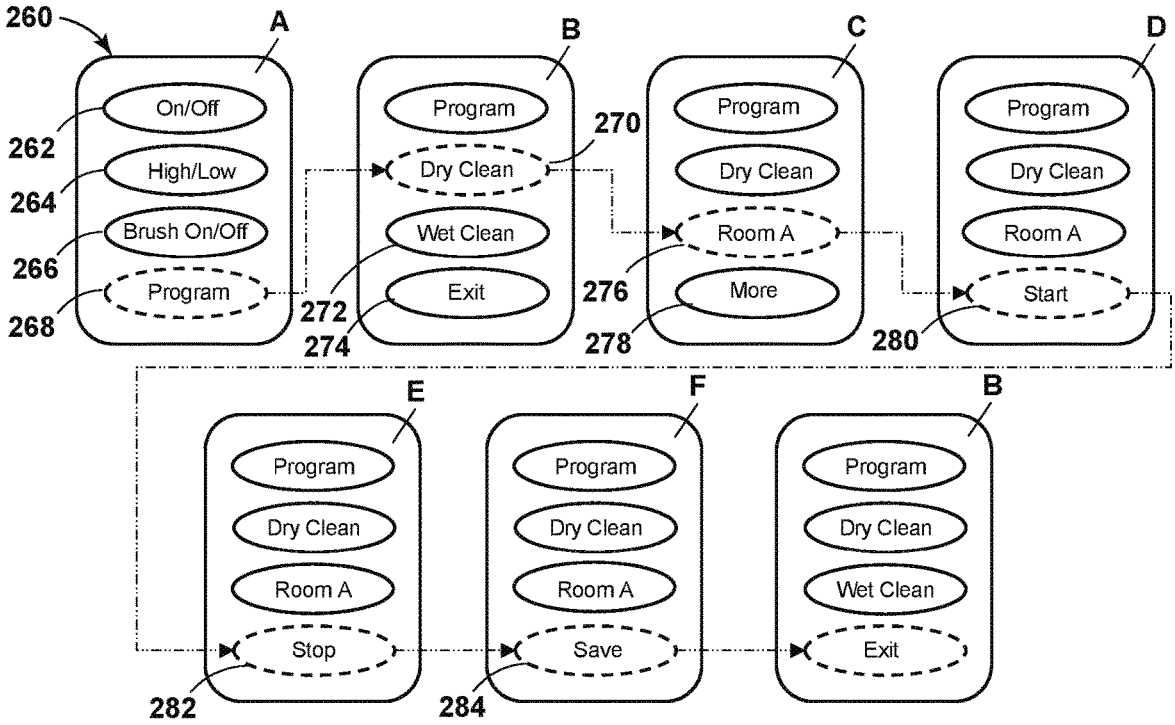
FIG. 21 is a schematic view showing a user interface display for the manual surface cleaning apparatus of FIG. 17 and one method of recording a cleaning path using the user interface display.

FIG. 21 show a user interface display 260 for controlling the manual vacuum cleaner 10. The user interface display 260 can be provided on the manual vacuum cleaner 10, such as at user interface (UI) 32, or on another input device, such as on the mobile device 110 or another remote user terminal.

The display 260 may be implemented an LED matrix display or a touchscreen, with various input controls operably connected to systems in the manual vacuum cleaner 10 to affect and control its operation. Alternatively, the display 260 can be another device capable of visually displaying various pieces of information, with a separate, non-touchscreen input unit provided for receiving control commands related to the operation of the manual vacuum cleaner 10.

FIG. 21 also illustrates a method where an application executed by the manual vacuum cleaner 10, mobile device 110, another remote user terminal receives a cleaning mode selected by a user, receives a path identifier selected by a user, records a cleaning path, and saves the recorded cleaning path with the path identifier. According to FIG. 21, when the user interface display 260 is activated, the application can execute a first screen A on the display 260, which can be main or home screen. The first screen A includes multiple user input controls, including an on/off control 262, high/low control 264, brush on/off control 266, and program control 268. The on/off control 262 is a power input control which controls the supply of power to one or more electrical components of the manual vacuum cleaner 10, and may perform a duplicate function as the input control 34 on the hand grip 26 (FIG. 2). The high/low control 264 controls the speed of the vacuum motor 64. Via the high/low control 264, the motor speed can be set to a first predetermined speed (i.e., a high speed) and a second predetermined speed (i.e. a low speed) which is less than the first predetermined speed. The brush on/off control 266 controls the brush motor 80. Via the brush on/off control, the brush motor 80 can be turned "on" for rotation of the brushroll 60 or turned "off" for no rotation of the brushroll 60. The program control 268 displays additional user-selectable controls for selecting a program or cleaning mode for the manual vacuum cleaner 10.

When the program control 268 is selected, the application can execute a second screen B on the display 260, which can include a dry clean mode control 270, a wet clean mode control 272, and an exit control 274. Selection of the dry clean mode control 270 operates the manual vacuum cleaner 10 in a dry clean mode in which the vacuum motor 64 is active and the pump 78 is inactive. Selection of the wet clean mode control 272 operates the manual vacuum cleaner 10 in a wet clean mode in which the vacuum motor 64 and pump 78 are both active. With the wet clean mode control 272 selected, flow rate can be controlled using the input control 36 on the hand grip 26 (FIG. 2), as described previously. Selecting the exit control 274 will return to the first screen A.

When either mode control 270, 272 is selected, the application can execute a third screen C on the display 260, which can include a path control 276 and a more control 278. The path control 276 may include a path identifier under which the cleaning path will be recorded. The more control 278 displays additional user-selectable controls, such as additional path controls with other path identifiers. In the embodiment shown herein, where the dry clean mode control 270 is selected on screen B, screen C may show that the cleaning path to be recorded will be in the dry cleaning mode. Optionally, the selected cleaning mode can be saved as part of the cleaning path so that the robot 10A will also perform in the same cleaning mode.

When a path control, such as control 276, is selected, the application can execute a fourth screen D on the display 260, which can include a start control 280. The start control 280 initiates recording once a desired cleaning mode and path identifier is selected. In the embodiment shown herein, where the path identifier control 276 is selected on screen B, screen C may show that the cleaning path to be recorded will be identified accordingly (i.e. "Room A").

When the start control 280 is selected, the controller 100 can begin to record the cleaning path. This may include tracking and storing sensor data, such as data from the wheel rotation sensor 130. During recording, the application can execute a fifth screen E on the display 260, which can include a stop control 282, which stops recording.

When the stop control 282 is selected, the controller 100 stops recording the cleaning path. In addition, when stop control 282 is selected, the application can execute a sixth screen F on the display 260, which can include a save control 284. Upon selection of the save control 284, the recorded cleaning path is saved. This may include saving recorded data from one or more sensors of the manual vacuum cleaner 10, including, but not limited to, the wheel rotation sensor 130. Optionally, after selection of the save control 284, the connectivity component 104 transmits the saved data to one or more of the remote computing devices 106, and the data is transcribed into instructions for a cleaning path to be followed by the robot 10A.

When save control 284 is selected, the application can execute the second screen B on the display 260, via which the user can choose to record another cleaning path or return back to the home screen A.

Figure 22:
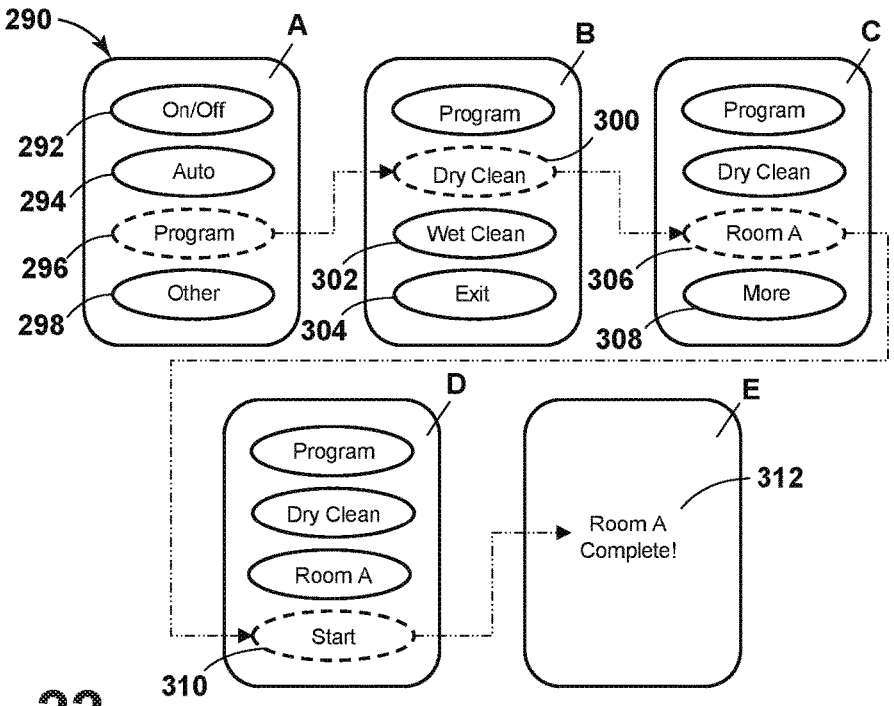
FIG. 22 is a schematic view showing a user interface display for the autonomous surface cleaning apparatus of FIG. 17 and a method of executing a recorded cleaning path using the user interface display.

FIG. 22 show a user interface display 290 for controlling the robot 10A. The user interface display 290 can be provided on the robot 10A, such as at user interface (UI) 32A, or on another input device, such as on the mobile device 110 or another remote user terminal.

The display 290 may be implemented an LED matrix display or a touchscreen, with various input controls operably connected to systems in the robot 10A to affect and control its operation. Alternatively, the display 290 can be another device capable of visually displaying various pieces of information, with a separate, non-touchscreen input unit provided for receiving control commands related to the operation of the robot 10A.

FIG. 22 also illustrates a method where an application executed by the robot 10A, mobile device 110, another remote user terminal receives a cleaning mode selected by a user, receives a cleaning path selected by a user and prerecorded by the manual vacuum cleaner 10, and autonomously travels the selected cleaning path in the selected cleaning mode. The cleaning path presented on the display 290 can use the same path identifier as the manual vacuum cleaner 10 used to record the cleaning path. According to FIG. 22, when the user interface display 290 is activated, the application can execute a first screen A on the display 290, which can be main or home screen. The first screen A includes multiple user input controls, including an on/off control 292, auto control 294, program control 296, and other control 298. The on/off control 292 is a power input control that controls the supply of power to one or more electrical components of the robot 10A. The auto control 294 operates the robot 10A in an auto mode in which the robot 10A does not follow a prescribed path, but rather cleans based on a random path informed by real-time feedback from the sensors of the robot 10A. The program control 296 displays additional user-selectable controls for selecting a program or cleaning mode for the robot 10A. The other control 298 displays additional user-selectable controls.

When the program control 296 is selected, the application can execute a second screen B on the display 290, which can include a dry clean mode control 300, a wet clean mode control 302, and an exit control 304. Selection of the dry clean mode control 300 operates the robot 10A in a dry clean mode in which a vacuum motor is active and a pump is inactive. Selection of the wet clean mode control 302 operates the robot 10A in a wet clean mode in which the vacuum motor and pump of the robot 10A are both active. Selecting the exit control 304 return to the first screen A.

When either mode control 300, 302 is selected, the application can execute a third screen C on the display 290, which can include a path control 306 and a more control 308. The path control 306 may display a path identifier. The more control 308 displays additional user-selectable controls, such as additional path controls with other path identifiers. In the embodiment shown herein, where the dry clean mode control 300 is selected on screen B, screen C may show that the selected cleaning path will be executed the dry cleaning mode. Thus, the user may select to run a prerecorded cleaning path as in the dry cleaning mode or in the wet cleaning mode. Alternatively, a recorded cleaning path can include a cleaning mode saved as part of the cleaning path so that the robot 10A will also perform in the same cleaning mode automatically upon selection of a cleaning path.

When a path control, such as control 306, is selected, the application can execute a fourth screen D on the display 290, which can include a start control 310. The start control 310 initiates autonomous cleaning once a desired path identifier is selected. In the embodiment shown herein, where the path control 306 is selected on screen B, screen C may show the path identifier for the cleaning path to be executed (i.e. "Room A").

When the start control 310 is selected, the robot 10A begins to execute the selected cleaning path, in the cleaning mode selected by the user, or alternatively recorded with the cleaning path. When the robot 10A has completed the cleaning path, the application can execute a fifth screen E on the display 290, which can include a message notifying the user that the robot 10A has completed the cleaning path (i.e. "Room A Complete!). Other messages including text, graphics, and/or other forms of visual content, can be displayed on screen E to indicate when cleaning is complete.

Figure 23:
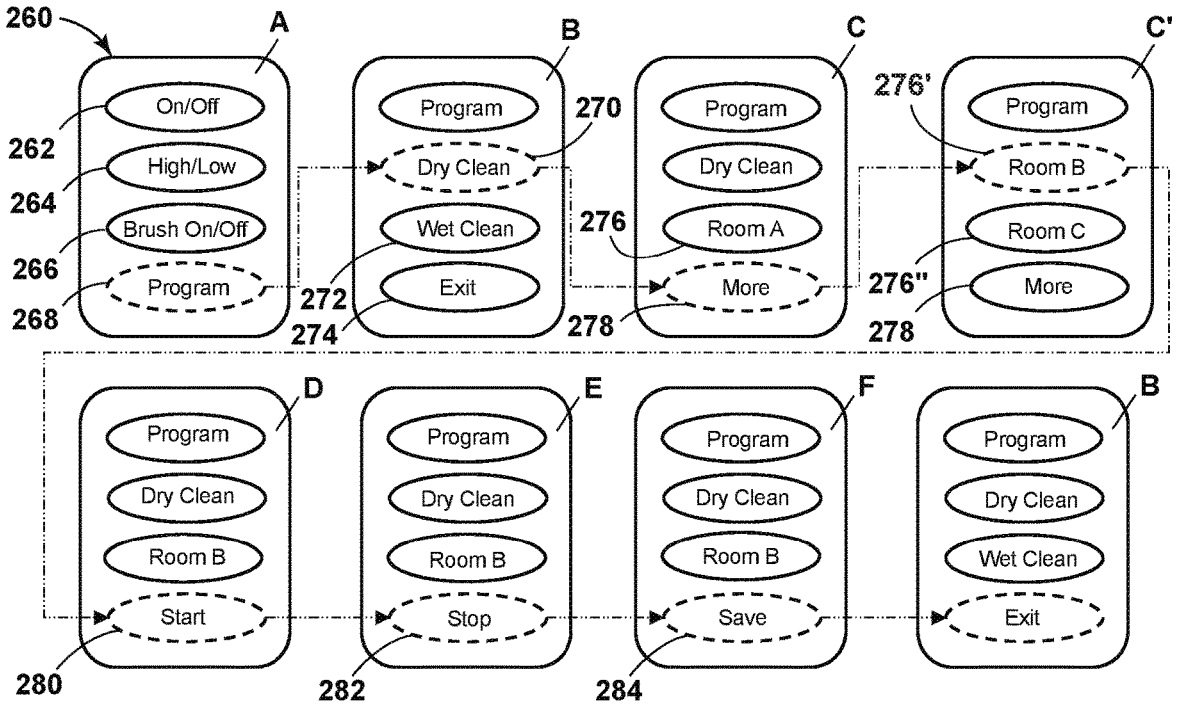
FIG. 23 is a schematic view showing another method of recording a cleaning path using the user interface display of FIG. 21.
Figure 24:
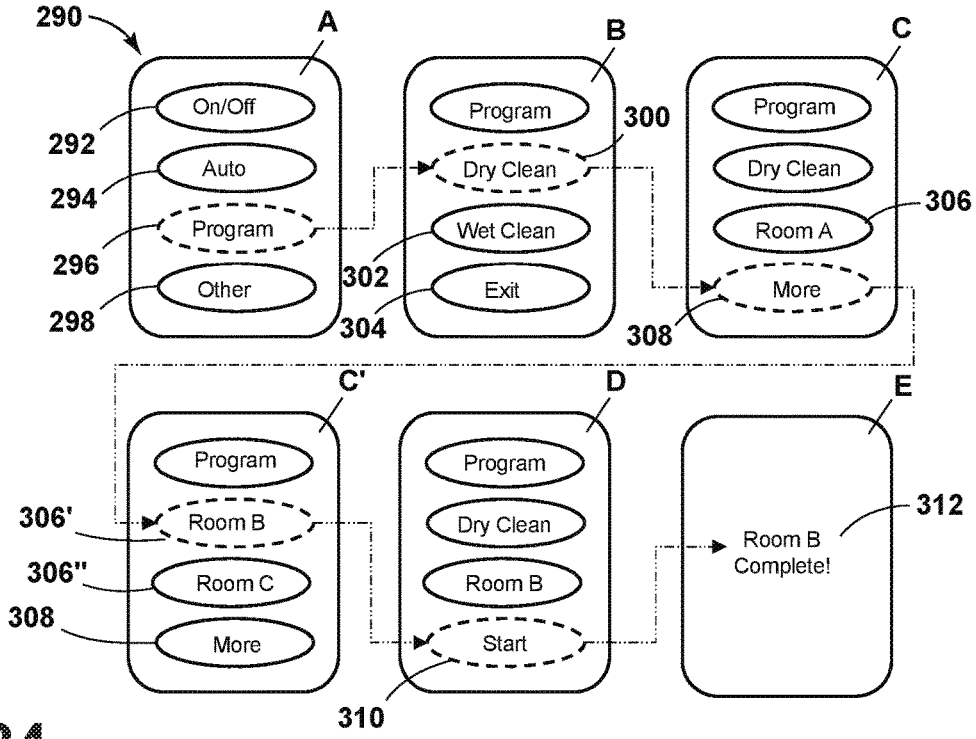
FIG. 24 is a schematic view showing another method of executing a recorded cleaning path using the user interface display of FIG. 21.

FIGS. 23-24 show another embodiment of the method where a user can record another cleaning path using manual vacuum cleaner 10 and later execute the recorded cleaning path using the robot 10A. Referring to FIG. 23, to record and save another cleaning path using the manual vacuum cleaner 10, upon selection of the more control 278 on screen C, the application can execute another screen C' on the manual vacuum cleaner display 260. Screen C' can display one or more additional path controls 276', 276" with other path identifiers (i.e., "Room B" and "Room C"). The user can select one of these other path controls 276', 276" and subsequently record a new cleaning path under the associated path identifier. Referring to FIG. 24, to execute the new cleaning path, upon selection of the mode control 308 on screen C, the application can execute another screen C' on the robot display 290. Screen C' can display one or more additional path controls 306', 306" with other path identifiers (i.e., "Room B" and "Room C"). The user can select one of these other path controls 306', 306" and subsequently execute the new cleaning path.

Figure 25:
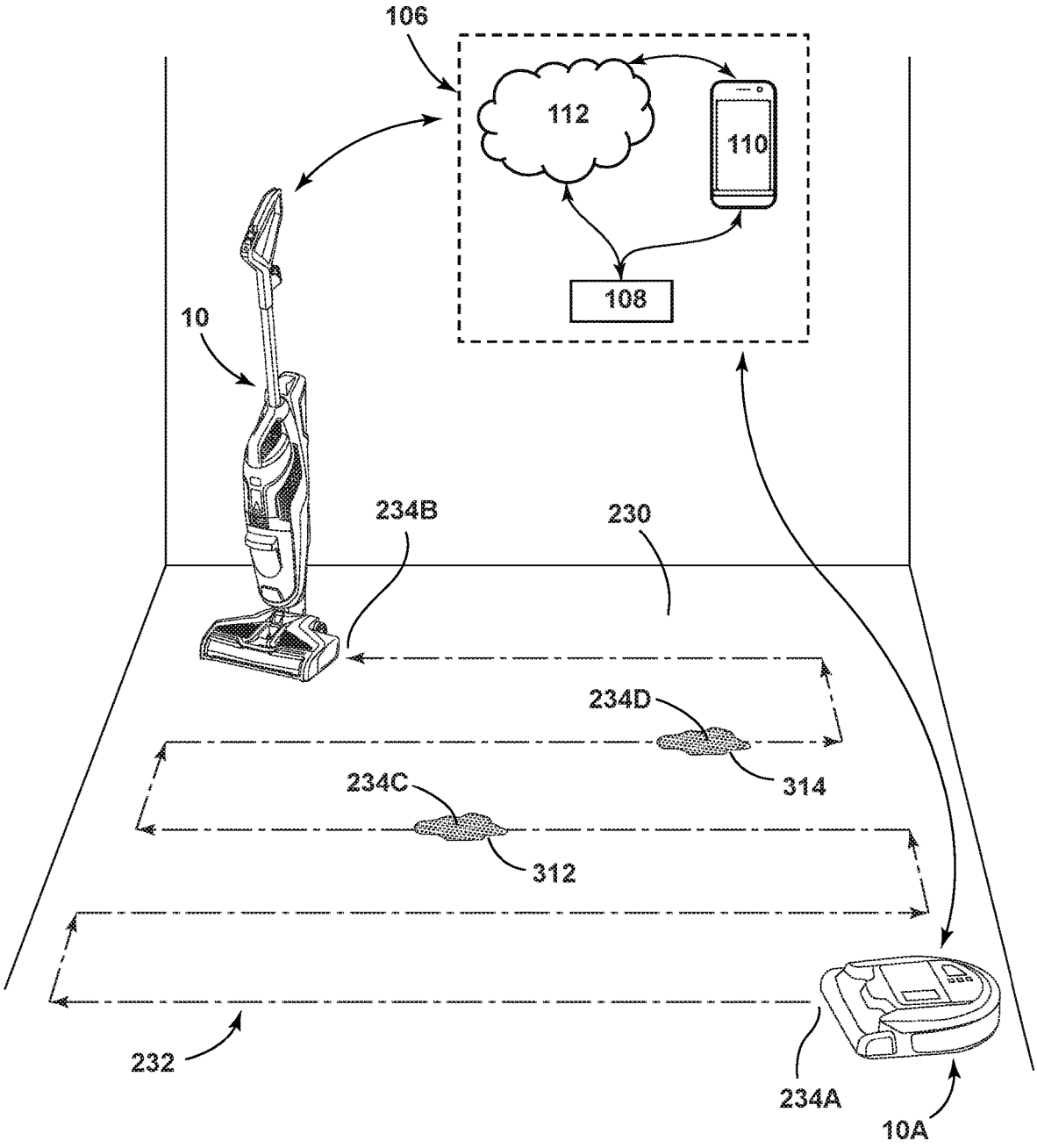
FIG. 25 is a schematic view depicting another method of operation using the system of FIG. 17, the method including detecting a stain with the manual surface cleaning apparatus and treating the stain with the autonomous surface cleaning apparatus.

FIG. 25 is a schematic view depicting another embodiment of a method of operation using the system. In this embodiment, the manual vacuum cleaner 10 can record floor type, stain sensing/location, and other information when recording the cleaning path 232, and share this information with the robot 10A. While recording the cleaning path 232, the manual vacuum cleaner 10 may detect information about the floor surface 230 using one or more of the sensor(s) 102 (FIG. 1). For example, the manual vacuum cleaner 10 may detect the floor type (ex: carpet, tile, hardwood, linoleum, etc.) using floor type sensor 124 and/or may detect at least one stain 312 on the floor surface 230 using the soil type sensor 136. Such a stain 312 is illustrated at detection position 234C. Along with the cleaning path, the manual vacuum cleaner 10 may record the size and/or shape of the stain 312, and the type of stain 312 (ex: food, wine, red dye, soil, or pet or other organic stain).

The remote computing device 106 can store the cleaning path 232 recorded by the manual floor cleaner 10, including the type of floor surface 230 and/or the information regarding the stain 312 detected, and transfer this information to the robot 10A. During a subsequent cycle of operation, the robot 10A can traverses the cleaning path, optionally stopping at position 234C to treat the stain 312.

Optionally, the remote computing device 106 can recommend a stain treatment cycle for the stain 312 based on information from one or more of the sensor(s) 102 of the manual vacuum cleaner 10. A stain treatment cycle may be recommended based on any of: floor type, the size and/or shape of the stain, and the type of stain. The stain treatment cycle can include a particular movement pattern, flow rate, solution amount, solution concentration, solution dwell time, brush operation time, extraction time, or any combination thereof that is appropriate for the stain. Once at the stain 312, the robot 10A can perform the stain treatment cycle sent by the device 106.

Alternatively, the robot 10A can use the information about the stain and floor surface type to clean the stain 312 accordingly. For example, the robot 10A can select a particular movement pattern, flow rate, solution amount, solution concentration, solution dwell time, brush operation time, extraction time, or any combination thereof that is appropriate for the stain and floor surface type.

During operation of the manual vacuum cleaner 10, the manual vacuum cleaner 10 may detect, or locate, more than one stain on the floor surface 230. In the embodiment shown in FIG. 25, at least one additional stain 314 is sensed at detection position 234D. The system can be configured to compile a list of stains 312, 314 logged by the manual vacuum cleaner 10, and the robot 10A can be deployed to treat each stain 312, 314 as part of the transcribed cleaning path.

Figure 26:
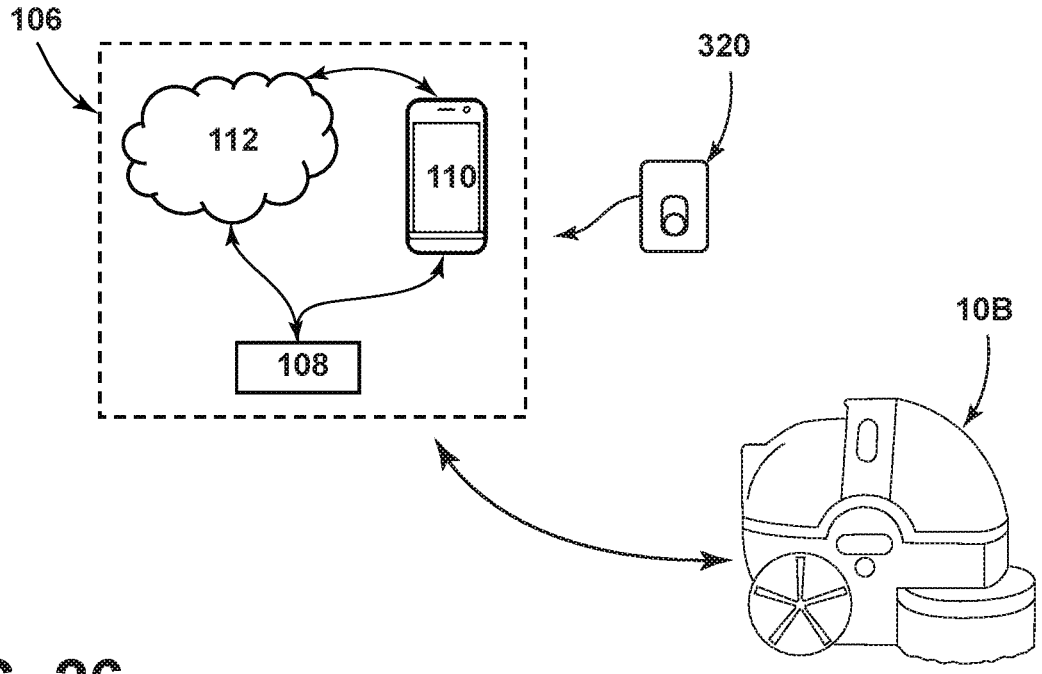
FIG. 26 is a schematic view of another embodiment of a system including a connected surface cleaning apparatus, the system further including a stain detection device.

FIG. 26 shows an embodiment where the system can be used with a surface cleaning apparatus comprising an unattended spot-cleaning apparatus or deep cleaner 10B. The system can further include a stain detection device 320 used to scan spots and stains for identification. The deep cleaner 10B and stain detection device 320 are configured to share information, such as stain location and stain type. In one embodiment, the stain detection device 320 detects a stain, and shares this information with the remote computing device 106. The remote computing device 106 is configured to transfer the stain information to the deep cleaner 10B for treatment of the stain. The deep cleaner 10B may move autonomously to the stain, and may be provided with location information in addition to stain type. Alternatively, the deep cleaner 10B may be a portable device that is manually placed at the stain, and may be provided stain type only.

Stain location information can be determined using an interior map or an active localization system that can determine the location of the stain relative to that of the deep cleaner 10B. The map location or relative coordinates are communicated to the deep cleaner 10B to enable navigation to the stain.

In one embodiment, the stain detection device 320 is a hand-held spectrometer used to scan stains for identification. Data from the spectrometer 320 is sent to the remote computing device 106 for analysis. The analysis can comprise an identification of the stain type (ex: food, wine, red dye, soil, or pet or other organic stain). Optionally, the spectrometer 320 can transmit data to the mobile device 110, and the mobile device 110 can transmit the data to the cloud computing/storage device 112. The data can be processed and analyzed by the cloud computing/storage device 112, and transmitted back to the mobile device 110 with the stain identification.

After analysis, the stain identification is relayed to the deep cleaner 10B. The stain identification can also be displayed to the user, such as on a user interface of the deep cleaner 10B or on the mobile device 110. The deep cleaner 10B can adjust one or more variables of a cleaning cycle, such as flow rate, solution amount, solution concentration, solution dwell time, brush operation time, brush movement pattern, deep cleaner movement pattern, extraction time, or any combination thereof, to achieve the best cleaning performance for the identified stain.

Figure 27:
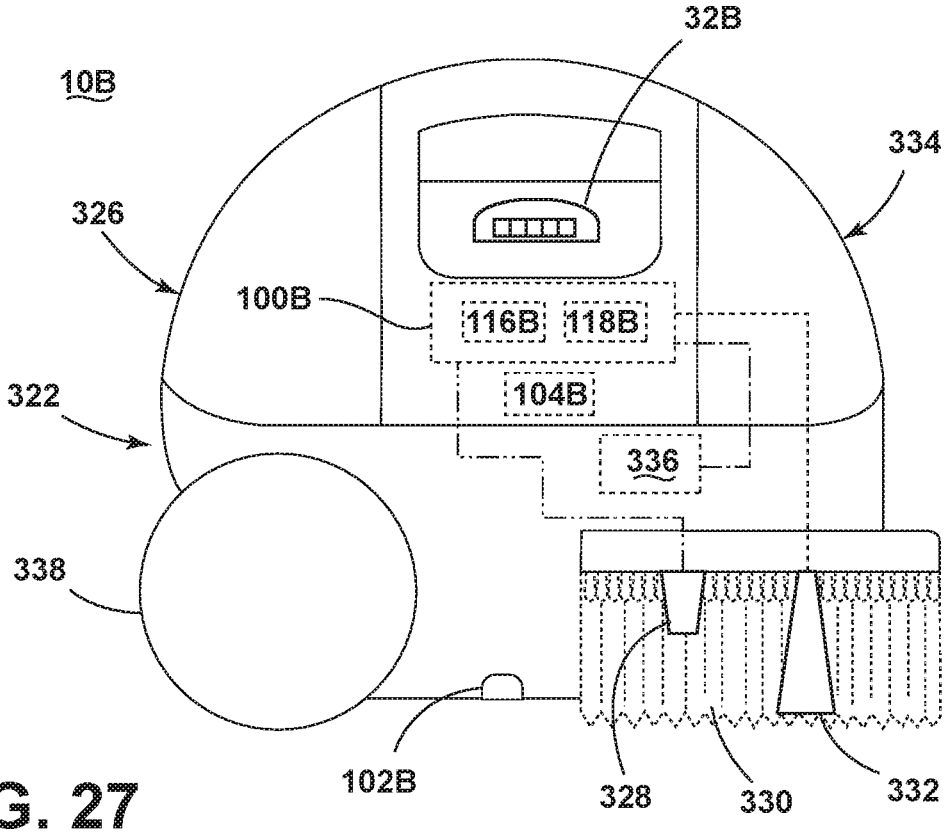
FIG. 27 is a schematic view of one embodiment of the surface cleaning apparatus for the system of FIG. 26.

FIG. 27 is a schematic view of one embodiment of the deep cleaner 10B which may be used in the system of FIG. 26. The deep cleaner 10B can comprise at least some of the same components as the surface cleaning apparatus 10 of FIG. 1, including at least user interface 32B, a controller 100B having a memory 116B and processor 118B, one or more sensors 102B, and a connectivity component 104B. The controller 100B is operably coupled with the various function systems of the deep cleaner 10B for controlling its operation. The controller 100B is configured to receive data provided by the remote computing device 106, including data from the stain detection device 320.

The deep cleaner 10B may be an autonomous deep cleaner or deep cleaning robot. The deep cleaning robot 10B mounts the components of various functional systems of the deep cleaner in an autonomously moveable unit or housing 322, including components of a fluid supply system for storing cleaning fluid and delivering the cleaning fluid to the surface to be cleaned, a fluid recovery system for removing the cleaning fluid and debris from the surface to be cleaned and storing the recovered cleaning fluid and debris, and a drive system for autonomously moving the deep cleaner 10B over the surface to be cleaned. The moveable unit 322 can include a main housing adapted to selectively mount components of the systems to form a unitary movable device. The deep cleaner 10B can have similar properties to the autonomous deep cleaner or deep cleaning robot described in U.S. Pat. No. 7,320,149 to Huffman et al., incorporated above.

The fluid delivery system can include a supply tank 326 for storing a supply of cleaning fluid and a fluid distributor 328 in fluid communication with the supply tank 326 for depositing a cleaning fluid onto the surface. The cleaning fluid can be a liquid such as water or a cleaning solution specifically formulated for carpet or hard surface cleaning. The fluid distributor 328 can be one or more spray nozzle(s) provided on the housing of the unit 322. Alternatively, the fluid distributor 328 can be a manifold having multiple outlets. Various combinations of optional components can be incorporated into the fluid delivery system as is commonly known in the art, such as a pump for controlling the flow of fluid from the tank 326 to the distributor 328, a heater for heating the cleaning fluid before it is applied to the surface, or one or more fluid control and/or mixing valve(s).

At least one agitator or brush 330 can be provided for agitating the surface to be cleaned onto which fluid has been dispensed. The brush 330 can be mounted for rotation about a substantially vertical axis, relative to the surface over which the unit 322 moves. A drive assembly including a motor (not shown) can be provided within the unit 322 to drive the brush 330. Other embodiments of agitators are also possible, including one or more stationary or non-moving brush(es), or one or more brush(es) that rotate about a substantially horizontal axis.

The fluid recovery system can include an extraction path through the unit having an air inlet and an air outlet, an extraction or suction nozzle 332 which is positioned to confront the surface to be cleaned and defines the air inlet, a recovery tank 334 for receiving dirt and liquid removed from the surface for later disposal, and a suction source 336 in fluid communication with the suction nozzle 332 and the recovery tank 334 for generating a working air stream through the extraction path. The suction source 336 can be a vacuum motor carried by the unit 322, fluidly upstream of the air outlet, and can define a portion of the extraction path. The recovery tank 334 can also define a portion of the extraction path, and can comprise an air/liquid separator for separating liquid from the working airstream. Optionally, a pre-motor filter and/or a post-motor filter (not shown) can be provided as well.

The drive system can include drive wheels 338 for driving the unit 322 across a surface to be cleaned. The drive wheels 338 can be operated by a common drive motor or individual drive motors (not shown) operably coupled with the drive wheels 338. The drive system can receive inputs from the controller 100B for driving the unit 322 across a floor, optionally based at least in part on inputs from the stain detection device 320. The drive wheels 338 can be driven in in a forward or reverse direction in order to move the unit 322 forwardly or rearwardly. Furthermore, the drive wheels 338 can be operated simultaneously or individually in order to turn the unit 322 in a desired direction.

Figure 28:
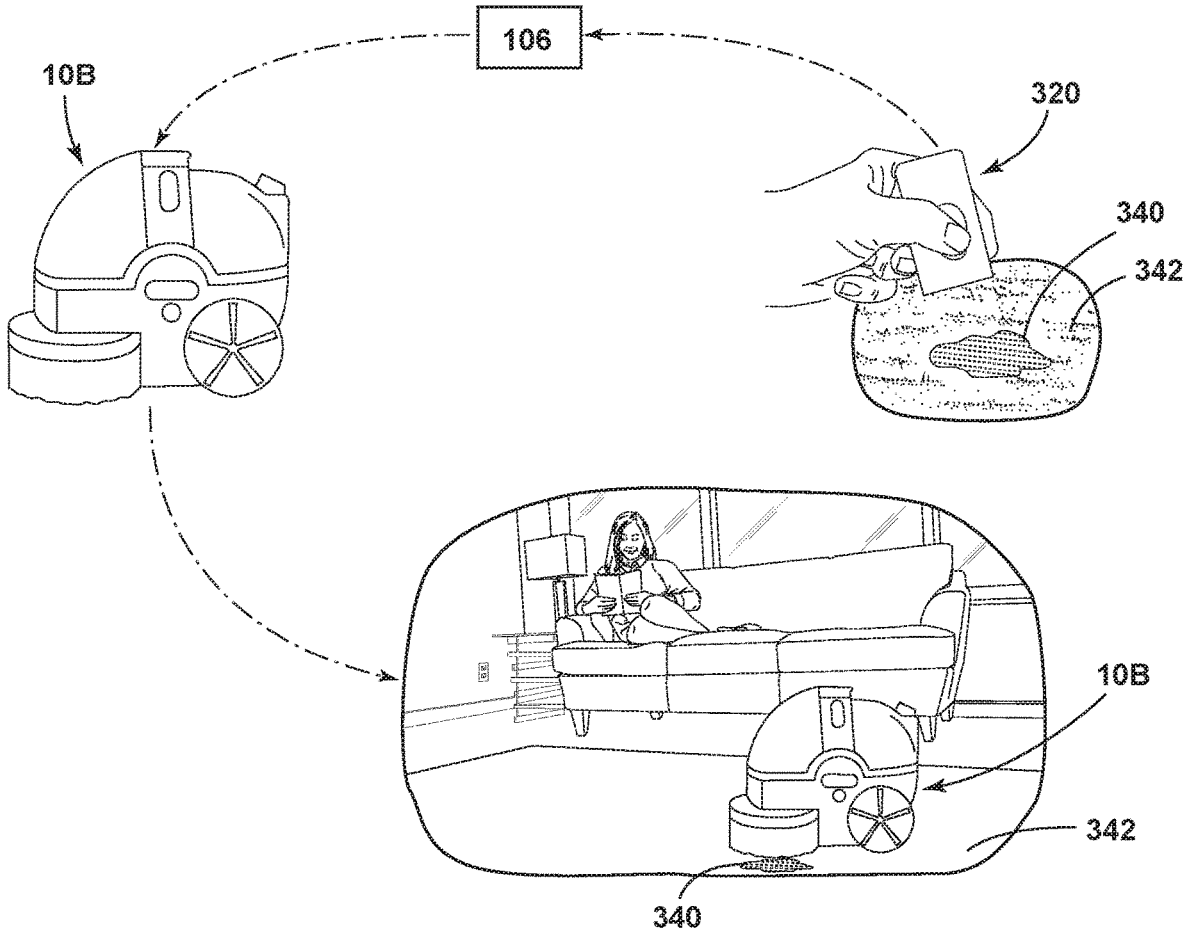
FIG. 28 is a schematic view depicting a method of operation using the system of FIG. 26.

FIG. 28 is a schematic view depicting a method of operation using the system of FIGS. 26-27. The method can begin with detecting a stain 340 on a floor surface 342 using the stain detection device 320 and collecting data from the stain 340. Stain data is wirelessly transmitted to the remote computing device 106 for analysis and identification of the stain 340. Stain data, which correlates to a stain identification and/or location, is wirelessly transmitted to deep cleaner 10B via communication between the remote computing device 106 and the connectivity component 104B. For example, the data can include the type of stain (ex: food, wine, red dye, soil, or pet or other organic stain). In another example, the data can include instructions for directing the drive system to move the deep cleaner 10B over the floor surface 342 to the location of the stain 340. Alternatively, the deep cleaner 10B may be manually placed at the stain 340, in which case the controller 100B may not receive stain location data. Using the stain data, the deep cleaner 10B can automatically configure a cleaning cycle for optimum cleaning of the identified stain 340. For example, the deep cleaner 10B can adjust one or more variables of a flow rate of solution dispensed from the distributor 328, a total amount of solution dispensed from the distributor 328, a concentration of solution dispensed from the distributor 328, a dwell time on the floor surface 342 for solution dispensed from the distributor 328, an operation time for the brush 330, a movement pattern for the brush 330, a movement pattern of the deep cleaner 10B, extraction time (i.e. operation time of the suction source 336), or any combination thereof, to achieve the best cleaning performance for the identified stain 340.

To the extent not already described, the different features and structures of the various embodiments of the invention, may be used in combination with each other as desired, or may be used separately. Thus, the various features of the different embodiments may be mixed and matched in various systems and floor cleaner configurations as desired to form new embodiments, whether or not the new embodiments are expressly described.

The above description relates to general and specific embodiments of the disclosure. However, various alterations and changes can be made without departing from the spirit and broader aspects of the disclosure as defined in the appended claims, which are to be interpreted in accordance with the principles of patent law including the doctrine of equivalents. As such, this disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

Likewise, it is also to be understood that the appended claims are not limited to express and particular components or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

What is claimed is:

1. A surface cleaning apparatus comprising:

an upright body comprising a handle and a frame;

a base adapted for contacting a surface to be cleaned, the base coupled with the upright body;

a moveable joint assembly mounting the base to the upright body, wherein the upright body is pivotable up and down about at least one axis relative to the base;

an electrically powered suction source comprising a vacuum motor;

a recovery tank fluidly coupled to the suction source and removably mounted to the frame;

an electrically powered pump in the base;

a supply tank fluidly coupled to the pump and removably mounted to the frame;

a dirt sensor in the base, the dirt sensor configured to generate dirt sensor data during a cycle of operation of the surface cleaning apparatus, the dirt sensor data correlating to a dirtiness of the surface to be cleaned;

a controller configured to process the dirt sensor data generated by the dirt sensor and to transmit a pump control signal to the pump to adjust a flow rate of cleaning fluid from the pump based on the dirt sensor data generated by the dirt sensor; and a connectivity component configured to wirelessly transmit the dirt sensor data to a remote computing device;

wherein the remote computing device is configured to identify, based on the transmitted dirt sensor data, at least one of:

a dirty floor event at the surface cleaning apparatus; and a change in the flow rate of cleaning fluid from the pump.

2. The surface cleaning apparatus of claim 1 wherein the dirt sensor is one of:

a turbidity sensor configured to generate dirt sensor data related to a turbidity of fluid within the recovery tank; and a soil sensor configured to generate dirt sensor data related to soil on the surface to be cleaned.

3. The surface cleaning apparatus of claim 1 wherein the dirt sensor comprises a turbidity sensor and the generated dirt sensor data correlates to a presence of particles suspended in a fluid within the recovery tank.

4. The surface cleaning apparatus of claim 1 comprising:

a suction nozzle on the base; and a brushroll provided adjacent to the suction nozzle to agitate the surface to be cleaned;

wherein the controller is configured to adjust brushroll speed based on the dirt sensor data generated by the dirt sensor.

5. The surface cleaning apparatus of claim 1 wherein:

the dirt sensor comprises a soil sensor that generates dirt sensor data related to soil on the surface to be cleaned, and the controller is configured to transmit at least one of:

a brush control signal to a brush motor to adjust an agitation duration of a brush in contact with the surface; and a motor control signal to the vacuum motor to adjust a suction duration of the vacuum motor based on the dirt sensor data generated by the dirt sensor.

6. The surface cleaning apparatus of claim 5 wherein the soil sensor comprises a near-infrared spectrometer and the generated dirt sensor data correlates to a spectrum of absorbed light reflected from the surface to be cleaned.

7. The surface cleaning apparatus of claim 1 comprising:

a pressure sensor configured to generate pressure sensor data during the cycle of operation of the surface cleaning apparatus, the pressure sensor data indicative of an outlet pressure of the pump;

wherein the connectivity component is configured to transmit the pressure sensor data to the remote computing device, and the remote computing device is configured to identify an empty supply tank event based on the transmitted pressure sensor data; and wherein the controller is configured to turn off a supply of power to the suction source and to the pump in response to an empty supply tank event.

8. The surface cleaning apparatus of claim 1 comprising:

a tank full sensor configured to generate tank full sensor data during the cycle of operation of the surface cleaning apparatus, the tank full sensor data indicative of a presence of fluid at a predetermined level within the recovery tank;

wherein the connectivity component is configured to transmit the tank full sensor data to the remote computing device, and the remote computing device is configured to identify a full recovery tank event based on the transmitted tank full sensor data; and wherein the controller is configured to turn off a supply of power to the suction source and pump in response to a full recovery tank event.

9. The surface cleaning apparatus of claim 1 comprising:

an air filter disposed in an air pathway fluidly coupling the electrically powered suction source to the recovery tank; and a filter status sensor configured to generate data during the cycle of operation of the surface cleaning apparatus, the data correlating to pressure in the air pathway;

wherein the connectivity component is configured to transmit the data to the remote computing device, and the remote computing device is configured to identify, based on the transmitted data, at least one of an operational status of the electrically powered suction source, an absence of the air filter, an absence of the recovery tank, and an air flow rate through the air filter.

10. The surface cleaning apparatus of claim 1 comprising:

a usage sensor configured to generate usage data during the cycle of operation of the surface cleaning apparatus, the usage data correlating to an elapsed time;

wherein the connectivity component is configured to transmit the usage data to the remote computing device, and the remote computing device is configured to identify, based on the transmitted usage data, at least one of: a single cycle operating time; a lifetime operating time; a date on which the surface cleaning apparatus was operated; and a time of day at which the surface cleaning apparatus was operated.

11. The surface cleaning apparatus of claim 1 wherein the surface cleaning apparatus comprises an upright multi-surface wet vacuum cleaner.

12. The surface cleaning apparatus of claim 1 comprising a user interface through which a user can interact with the surface cleaning apparatus, the user interface configured to provide a notification to the user based on the dirt sensor data generated by the dirt sensor, wherein the user interface comprises a display disposed at an upper end of the frame above the recovery tank and the supply tank.

13. The surface cleaning apparatus of claim 1 comprising a battery, the frame comprising a battery housing in which the battery is located, the battery housing disposed at a lower rear side of the frame, behind the recovery tank.

14. The surface cleaning apparatus of claim 1 comprising a recovery system including the suction source, the recovery tank, and a suction nozzle on the base, wherein the dirt sensor comprises a turbidity sensor and the generated dirt sensor data correlates to a presence of particles suspended in fluid recovered by the recovery system.

15. A method of controlling flow rate for a surface cleaning apparatus having a base adapted for contacting a surface of a surrounding environment to be cleaned, an electrically powered suction source comprising a vacuum motor, a recovery system comprising a recovery tank fluidly coupled to the suction source, an electrically powered pump, and a fluid delivery system comprising a supply tank fluidly coupled to the pump, the method comprising:

sensing a dirtiness of the surface to be cleaned by generating dirt sensor data during a cycle of operation of the surface cleaning apparatus with a dirt sensor onboard the surface cleaning apparatus, the dirt sensor data correlating to the dirtiness of the surface to be cleaned;

processing the dirt sensor data to generate a pump control signal that instructs the pump to change a flow rate of cleaning fluid from the pump based on the dirt sensor data;

transmitting the pump control signal to the pump to change the flow rate of cleaning fluid from the pump;

transmitting the dirt sensor data to a remote computing device;

receiving the dirt sensor data at the remote computing device;

processing the received dirt sensor data to identify, based on the transmitted dirt sensor data, at least one of:

a dirty floor event at the surface cleaning apparatus; and a change in the flow rate of cleaning fluid from the pump; and providing to a user of the surface cleaning apparatus, via the remote computing device, a notification of at least one of the dirty floor event at the surface cleaning apparatus and the change in the flow rate of cleaning fluid from the pump.

16. The method of claim 15 wherein, during the cycle of operation, the flow rate of cleaning fluid is dynamically updated based on dirt sensor data from the dirt sensor.

17. The method claim 15 wherein the dirt sensor comprises at least one of:

a turbidity sensor, and sensing the dirtiness of the surface to be cleaned comprises sensing a turbidity of fluid recovered by the recovery system; and a soil sensor, and sensing the dirtiness of the surface to be cleaned comprises sensing a spectrum of absorbed light reflected from the surface to be cleaned.

18. The method claim 15 comprising increasing the flow rate of cleaning fluid from the pump in response to a dirty floor event at the surface cleaning apparatus identified based on the transmitted dirt sensor data.

19. The method claim 15 comprising providing to the user, via a user interface on the surface cleaning apparatus, a notification of at least one of the dirty floor event at the surface cleaning apparatus and the change in the flow rate of cleaning fluid from the pump.

20. The method of claim 15, wherein:

processing the dirt sensor data to generate a pump control signal comprises processing the dirt sensor data onboard the surface cleaning apparatus; and processing the received dirt sensor data to identify at least one of an event and a change in the cycle of operation of the apparatus comprises processing the received dirt sensor data on the remote computing device.

* * * * *